US009810112B2

(12) United States Patent
Hikita et al.

(10) Patent No.: US 9,810,112 B2
(45) Date of Patent: Nov. 7, 2017

(54) LUBRICANT FEED MECHANISM FOR ENGINE

(71) Applicant: TAIHO KOGYO CO., LTD., Toyota-shi, Aichi (JP)

(72) Inventors: Yasuhiro Hikita, Toyota (JP); Tomomi Azuma, Toyota (JP)

(73) Assignee: TAIHO KOGYO CO., LTD., Toyota-Shi, Aichi (JP)

( * ) Notice: Subject to any disclaimer, the term of this patent is extended or adjusted under 35 U.S.C. 154(b) by 216 days.

(21) Appl. No.: 14/431,475

(22) PCT Filed: Sep. 20, 2013

(86) PCT No.: PCT/JP2013/075417
§ 371 (c)(1),
(2) Date: Mar. 26, 2015

(87) PCT Pub. No.: WO2014/050716
PCT Pub. Date: Apr. 3, 2014

(65) Prior Publication Data

US 2015/0260062 A1 Sep. 17, 2015

(30) Foreign Application Priority Data

Sep. 26, 2012 (JP) ..... 2012-213201

(51) Int. Cl.
*F01M 1/08* (2006.01)
*F01M 9/10* (2006.01)
(Continued)

(52) U.S. Cl.
CPC ..... *F01M 1/08* (2013.01); *F01M 1/06* (2013.01); *F01M 9/10* (2013.01); *F01M 9/101* (2013.01);
(Continued)

(58) Field of Classification Search
CPC ..... F01M 1/08; F01M 9/101; F01M 11/02; F01M 9/10; F01M 9/102; F01M 1/06
See application file for complete search history.

(56) References Cited

U.S. PATENT DOCUMENTS 7,096,933 B1 * 8/2006 Zia ..... F24H 3/105 126/110 R
7,574,991 B2 8/2009 Kumagai et al.

FOREIGN PATENT DOCUMENTS

DE 3520876 C1 9/1986
DE 3609206 A1 10/1986
(Continued)

OTHER PUBLICATIONS

Machine Translation of DE 3520876 C1 with Drawings.*
(Continued)

*Primary Examiner* — Jacob Amick
(74) *Attorney, Agent, or Firm* — Buchanan Ingersoll & Rooney PC

(57) ABSTRACT

Provided is a lubricant feed mechanism for an engine capable of achieving manufacturing cost reduction. A lubricant feed mechanism for an engine (1) is configured to feed lubricant through a cylinder head (10), a camshaft (an intake-side camshaft (40); an exhaust-side camshaft (42)), a cam cap (50), and an oil feed member (100) to a cam (a cam (40*a*); a cam (42*a*)) of a valve gear (30). The oil feed member (100) is formed by folding one panel member, and the inside surface of the oil feed member (100) in the folded state is recessed so as to form an oil passage (a first oil passage (114); a second oil passage (116); a third oil passage (118)) for guiding lubricant fed through the cam cap (50) to the cam.

20 Claims, 23 Drawing Sheets

(51) Int. Cl.

| | |
|---|---|
| ***F01M 11/02*** | (2006.01) |
| ***F01M 1/06*** | (2006.01) |
| *F01L 1/047* | (2006.01) |

(52) U.S. Cl.
CPC ..... *F01M 9/102* (2013.01); *F01M 11/02* (2013.01); *F01L 2001/0476* (2013.01); *F01L 2810/02* (2013.01)

(56) References Cited

FOREIGN PATENT DOCUMENTS

| | | | |
|---|---|---|---|
| JP | 2001-32705 | A | 2/2001 |
| JP | 2005-163703 | A | 6/2005 |
| JP | 4365373 | B2 | 11/2009 |
| JP | 2010-164009 | A | 7/2010 |
| JP | 2010-261361 | A | 11/2010 |
| JP | 2011-021522 | A | 2/2011 |

OTHER PUBLICATIONS

Office Action dated Dec. 8, 2015, by the Japanese Patent Office in corresponding Japanese Patent Application No. 2012-213201. (5 pages).
International Search Report (PCT/ISA/210) dated Oct. 15, 2013, by the Japanese Patent Office as the International Searching Authority for International Application No. PCT/JP2013/075417.
The extended European Search Report dated May 20, 2016, by the European Patent Office in corresponding European Application No. 13841567.4. (5 pages).

* cited by examiner

LUBRICANT FEED MECHANISM FOR ENGINE

TECHNICAL FIELD

The present invention relates to a technology of a lubricant feed mechanism for an engine for feeding lubricant to a cam of a valve gear through a cylinder head, a camshaft, a cam cap, and an oil feed member.

BACKGROUND ART

A technology of a lubricant feed mechanism for an engine has been known by which lubricant is fed to a cam of a valve gear through a cylinder head, a camshaft, a cam cap, and an oil feed member. Examples include Patent Document 1.

A lubricant feed mechanism for an engine described in Patent Document 1 includes a cylinder head having a bearing, a camshaft rotatably supported by the bearing, a cam cap fixedly attached to the cylinder head from the upper side to hold the camshaft therewith, and a cam shower pipe connected to an upper portion of the cam cap.

Further, the lubricant feed mechanism includes a communicating oil passage from an oil gallery of the cylinder head to the camshaft (bearing), an oil passage penetrating the camshaft (cam journal), and a communicating oil passage that is provided in the cam cap and connects the camshaft to the cam shower pipe.

In the lubricant feed mechanism thus configured, lubricant that circulates through the oil gallery is fed to a plurality of cams of a valve gear through the cylinder head, the camshaft, the cam cap, and the cam shower pipe. Thus, lubricant of a substantially equal amount can be fed to the plurality of cams by extracting lubricant from the oil gallery of a relatively large diameter, i.e., with a less pressure loss.

However, according to the technology described in Patent Document 1, the cam shower pipe for feeding lubricant to the cams needs to be folded or brazed appropriately, and a process for making an aperture in the cam shower pipe is also necessary. Thus, the technology described in Patent Document 1 has a disadvantage of high manufacturing cost.

RELATED ART DOCUMENT

Patent Document

Patent Document 1: Japanese Unexamined Patent Application Publication No. 2010-164009.

SUMMARY OF THE INVENTION

Problems to be Solved by the Invention

The present invention was made in view of the foregoing circumstances, in order to provide a lubricant feed mechanism for an engine capable of achieving manufacturing cost reduction.

Solutions to the Problems

A problem to be solved by the present invention is as described above, and the solutions to the problems will be described hereafter.

More specifically, a lubricant feed mechanism for an engine according to the present invention is configured to feed lubricant to a cam of a valve gear through a cylinder head, a camshaft, a cam cap, and an oil feed member. The oil feed member is formed by folding one panel member, and the inside surface of the oil feed member in the folded state is recessed so as to form an oil passage for guiding lubricant fed through the cam cap to the cam.

In the lubricant feed mechanism for an engine according to the present invention, the oil feed member is integrally provided over a plurality of cylinders of an engine.

In the lubricant feed mechanism for an engine according to the present invention, the oil feed member includes a guide portion for positioning the oil feed member with respect to the cam cap by plastically deforming a part of the oil feed member.

In the lubricant feed mechanism for an engine according to the present invention, the cam cap includes a guide portion for positioning the cam cap with respect to the oil feed member.

In the lubricant feed mechanism for an engine according to the present invention, the oil feed member is fastened together with the cam cap and is fixed to the cylinder head.

In the lubricant feed mechanism for an engine according to the present invention, the cam cap has a recess, and the oil feed member has a portion contained within the recess of the cam cap and is disposed in the cam cap.

In the lubricant feed mechanism for an engine according to the present invention, the oil passage provided in the oil feed member has a plurality of branches from a middle portion thereof and has a plurality of discharge ports for feeding lubricant to the cam.

In the lubricant feed mechanism for an engine according to the present invention, the above-described branched oil passages may have the same length, the same cross-sectional shape, the same number of turns, and the same angle of turning.

Effects of the Invention

The present invention provides effects as follows.

With the lubricant feed mechanism for an engine according to the present invention, the oil feed member can be formed by only press working, and thereby reduction of the manufacturing cost is achieved.

With the lubricant feed mechanism for an engine according to the present invention, reduction of the manufacturing cost is achieved compared with the case where separate oil feed members are provided per cylinder. Further, the oil feed member is integrally provided over a plurality of cylinders, thus allowing the oil feed member to increase the rigidity thereof.

With the lubricant feed mechanism for an engine according to the present invention, attachment work of the oil feed member can be facilitated with respect to the cam cap. Further, since the guide portion can also be formed by press working, increase of the manufacturing cost can be suppressed.

With the lubricant feed mechanism for an engine according to the present invention, attachment work of the oil feed member can be facilitated with respect to the cam cap.

With the lubricant feed mechanism for an engine according to the present invention, reduction of the manufacturing cost is achieved.

With the lubricant feed mechanism for an engine according to the present invention, lubricant can be fed to a cam without using the space above the cam cap. With this configuration, interference between members can be prevented, and design changes for avoiding the interference are obviated.

With the lubricant feed mechanism for an engine according to the present invention, lubricant can be fed from a plurality of discharge ports to a cam.

With the lubricant feed mechanism for an engine according to the present invention, the same amount of lubricant can be fed to a plurality of branched oil passages.

EMBODIMENTS OF THE INVENTION

Figure 1:
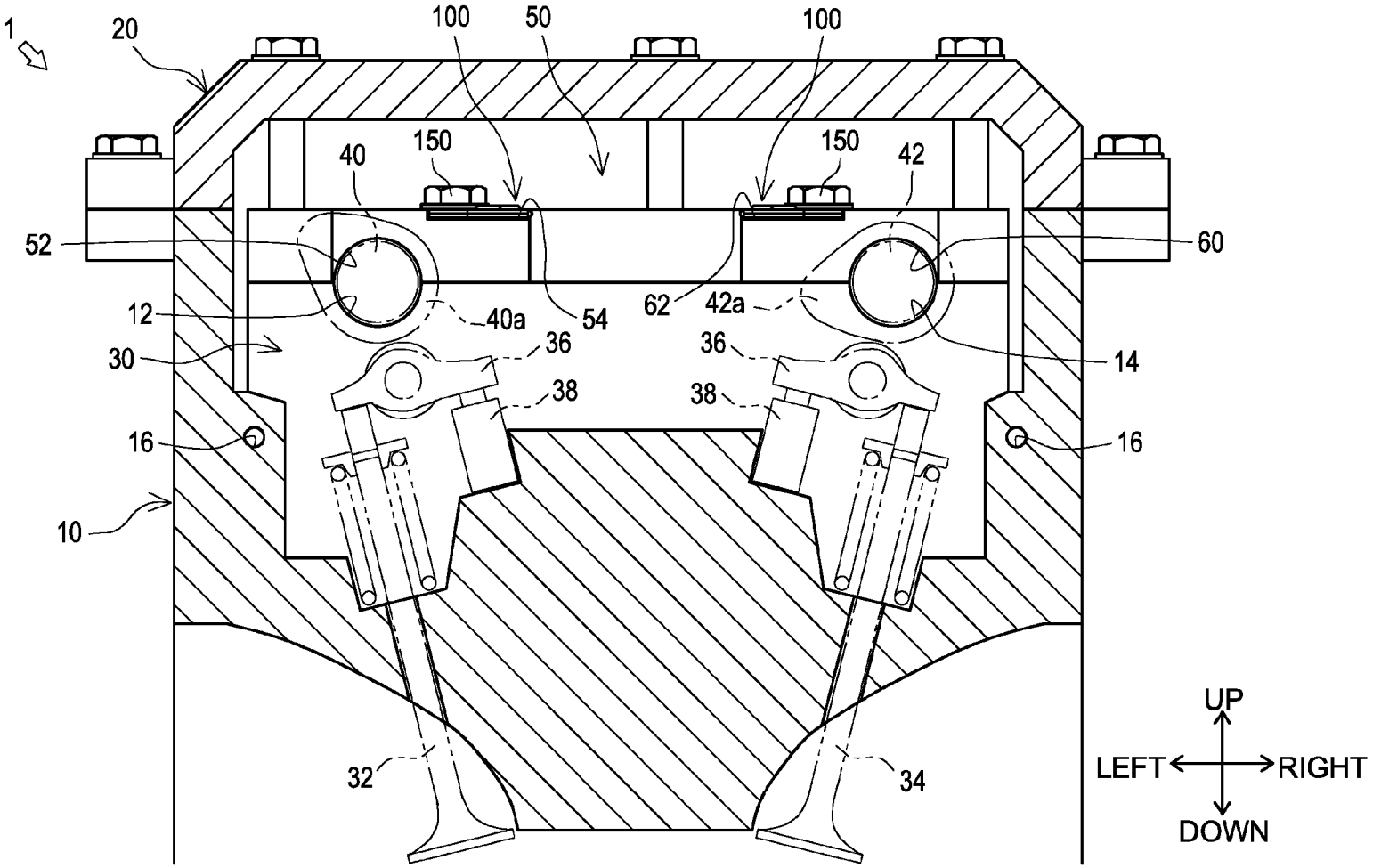
FIG. 1 is a cross-sectional view of the inside of a cylinder head cover of an engine according to a first embodiment of the present invention.

In the description below, the up-down direction, the right-left direction, and the front-back direction are defined by the arrows depicted in the figures.

First, description is given with reference to FIGS. 1 to 14B of a configuration of an engine 1 including a lubricant feed mechanism according to a first embodiment of the present invention.

The engine 1 according to the present embodiment is an inline 4-cylinder double overhead camshaft (DOHC) 16-valve gasoline engine. Description is given below mainly focusing on one cylinder of the four cylinders arranged in the front-back direction. The engine 1 mainly includes a cylinder head 10, a cylinder head cover 20, a valve gear 30, cam caps 50, and oil feed members 100.

Figure 3:
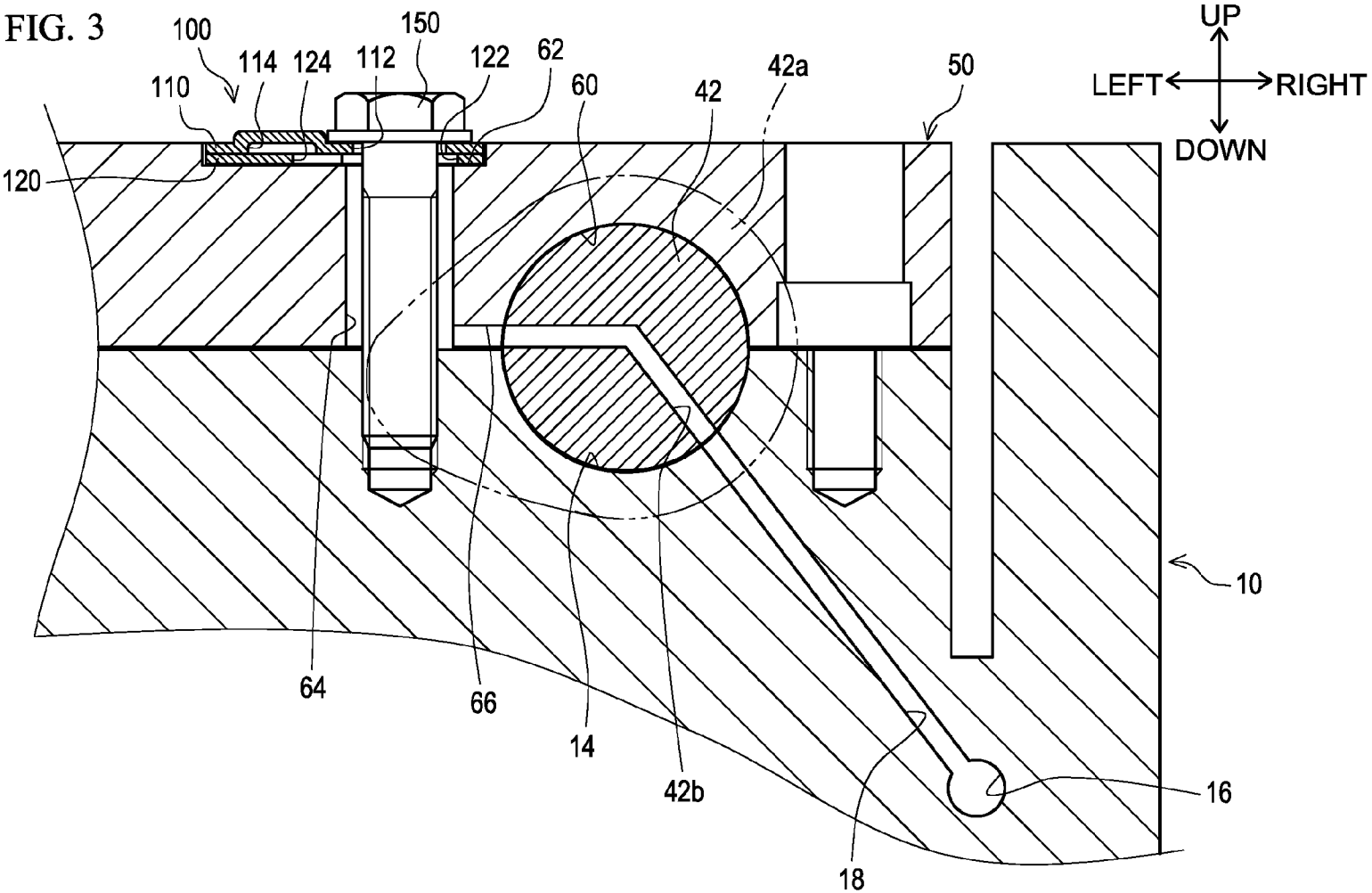
FIG. 3 is a cross-sectional view taken along line A-A in FIG. 2.
Figure 5:
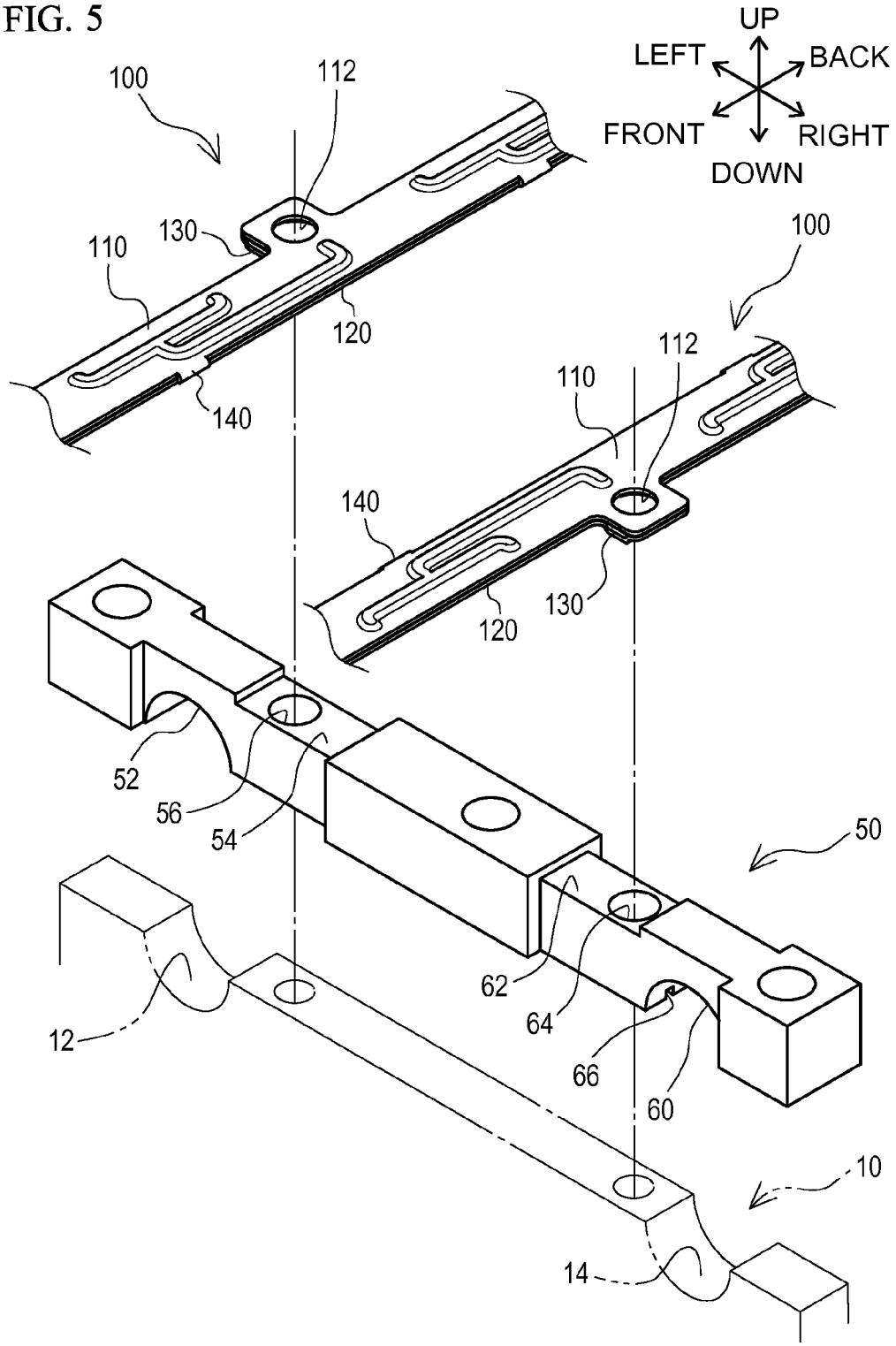
FIG. 5 is an exploded perspective view of the members depicted in FIG. 4.

The cylinder head 10 depicted in FIGS. 1, 3, and 5 makes a principal structural body of the engine 1 together with a cylinder block (not shown). The cylinder head 10 is fixedly attached to an upper portion of the cylinder block (not shown). The cylinder head 10 mainly includes an intake-side bearing 12, an exhaust-side bearing 14, an oil gallery 16, and a cam journal oil passage 18.

The intake-side bearing 12 depicted in FIGS. 1 and 5 rotatably supports from the lower side an intake-side camshaft 40 to be described later. The intake-side bearing 12 is provided at a left portion of the cylinder head 10 so as to be recessed in a semicircular shape with the upper side open in front view.

The exhaust-side bearing 14 depicted in FIGS. 1, 3, and 5 rotatably supports from the lower side an exhaust-side camshaft 42 to be described later. The exhaust-side bearing 14 is provided at a right portion of the cylinder head 10 so as to be recessed in a semicircular shape with the upper side open in front view.

The oil gallery 16 depicted in FIGS. 1 and 3 is an oil passage for guiding lubricant to various portions of the engine 1, such as a lash adjuster 38 to be described later. The oil gallery 16 is provided so as to pass the vicinity of right and left sidewalls of the cylinder head 10 in the front-back direction.

The cam journal oil passage 18 depicted in FIG. 3 is provided at a right portion of the cylinder head 10 so as to guide lubricant to the exhaust-side bearing 14. The cam journal oil passage 18 has a first end communicating with the oil gallery 16, whereas the cam journal oil passage 18 has a second end communicating with the exhaust-side bearing 14 of the cylinder head 10.

Although not illustrated in the present embodiment, the cam journal oil passage 18 is also provided at a left portion of the cylinder head 10 to communicate the oil gallery 16 on the left side with the intake-side bearing 12.

The cylinder head cover 20 depicted in FIG. 1 covers over the cylinder head 10. The cylinder head cover 20 is placed on an upper portion of the cylinder head 10 and is appropriately secured thereto by, for example, a bolt.

The valve gear 30 depicted in FIG. 1 is configured to open and close an intake port and an exhaust port (not shown) of the engine 1 at a predetermined timing. The valve gear 30 mainly includes an intake valve 32, an exhaust valve 34, rocker arms 36, lash adjusters 38, the intake-side camshaft 40, and the exhaust-side camshaft 42.

The intake valve 32 is configured to open and close the intake port (not shown) of the engine 1. The intake valve 32 is positioned with the longitudinal direction thereof directed substantially in the up-down direction. The intake valve 32 has a lower end extended to the intake port.

Although not illustrated in the present embodiment, two intake valves 32 are arranged in line in the front-back direction with respect to one cylinder.

The exhaust valve 34 is configured to open and close the exhaust port (not shown) of the engine 1. The exhaust valve 34 is positioned with the longitudinal direction thereof directed substantially in the up-down direction. The exhaust valve 34 has a lower end extended to the exhaust port.

Although not illustrated in the present embodiment, two exhaust valves 34 are arranged in line in the front-back direction with respect to one cylinder.

The rocker arms 36 are configured to openably/closably drive the intake valve 32 and the exhaust valve 34. The rocker arms 36 have first ends that abut the respective upper ends of the intake valve 32 and the exhaust valve 34 from the upper side.

The lash adjusters 38 are configured to adjust valve clearances. The lash adjusters 38 each abut the respective second ends of the rocker arms 36 from the lower side.

Figure 2:
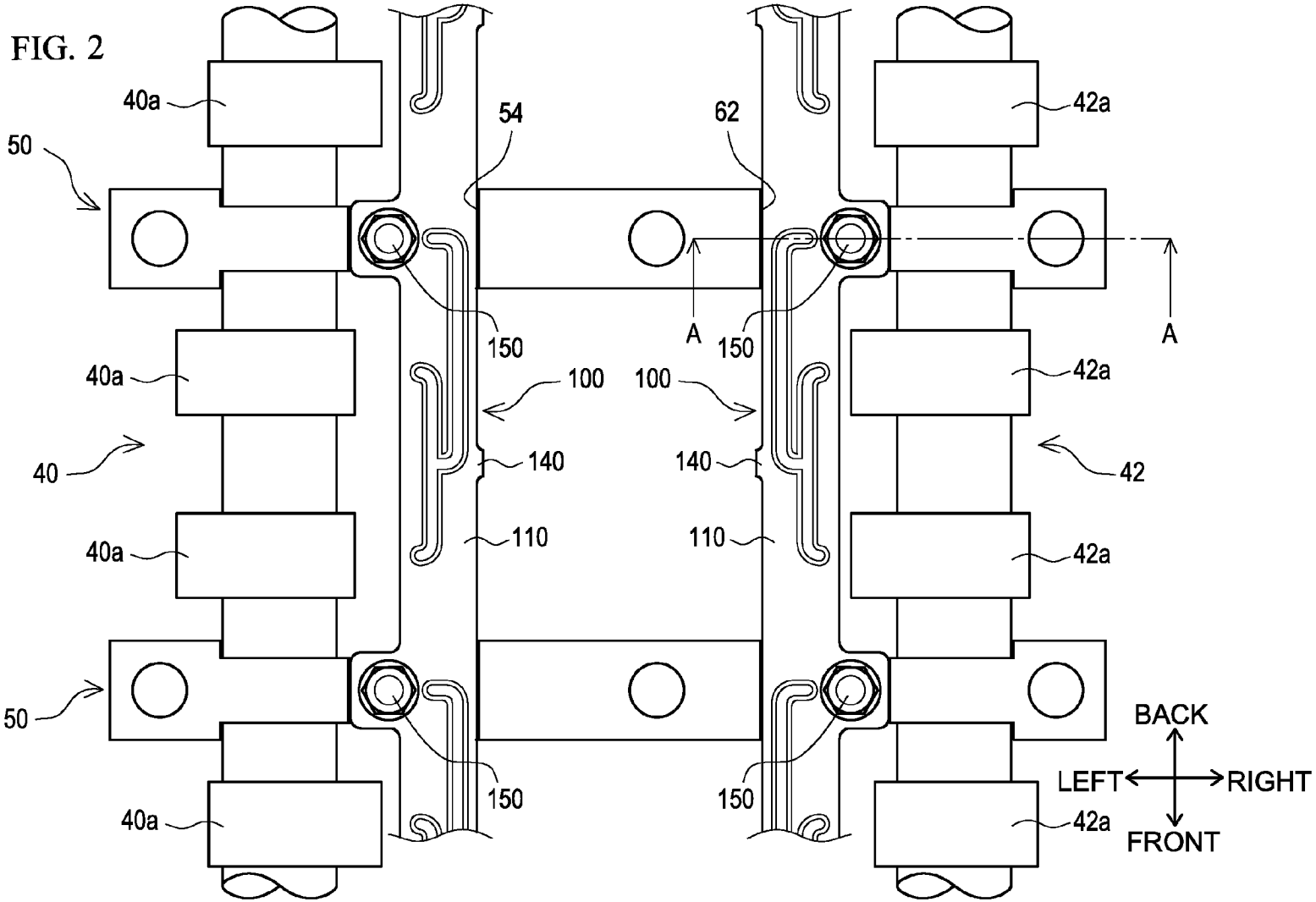
FIG. 2 is a plan view depicting cam caps and oil feed members.
Figure 4:
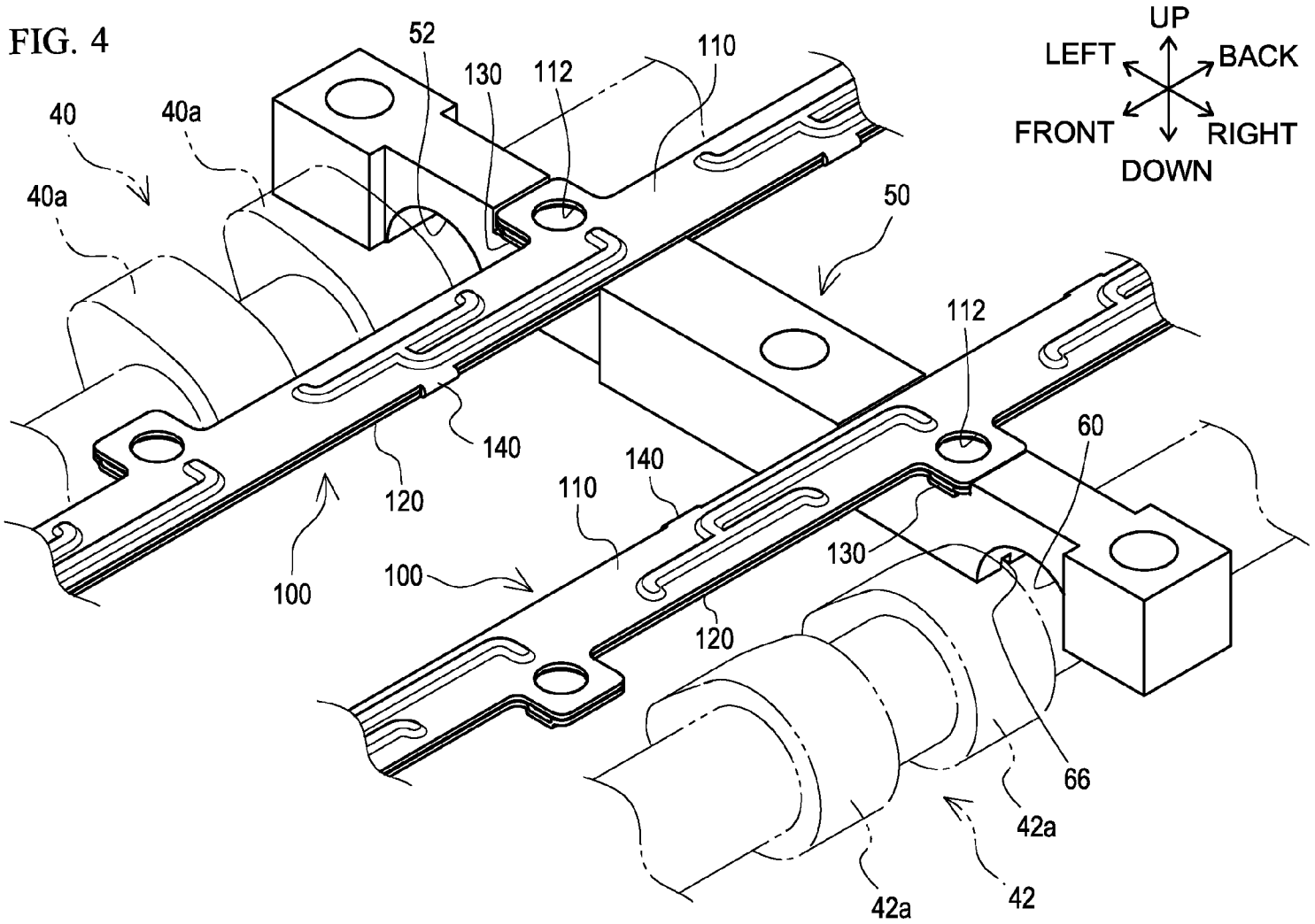
FIG. 4 is a perspective view depicting the cam cap and the oil feed members.

The intake-side camshaft 40 depicted in FIGS. 1, 2, and 4 is one embodiment of the camshaft according to the present invention, and is configured to rock a rocker arm 36 at a predetermined timing so as to openably/closably drive the intake valve 32. The intake-side camshaft 40 is placed on the intake-side bearing 12 of the cylinder head 10 with the longitudinal direction thereof directed in the front-back direction. The intake-side camshaft 40 mainly includes cams 40*a*.

The cams 40*a* are portions that have a planar shape with a non-uniform distance from the center of rotation, i.e., the center of the intake-side camshaft 40, to the outer periphery. Two cams 40*a* are arranged in line at a portion frontward of the portion (the cam journal) of the intake-side camshaft 40 placed on the intake-side bearing 12 of the cylinder head 10. The cams 40*a* abut the rocker arm 36 on the intake valve 32 side from the upper side.

The exhaust-side camshaft 42 depicted in FIGS. 1, 2, and 4 is one embodiment of the camshaft according to the present invention, and is configured to rock a rocker arm 36 at a predetermined timing so as to openably/closably drive the exhaust valve 34. The exhaust-side camshaft 42 is placed on the exhaust-side bearing 14 of the cylinder head 10 with the longitudinal direction thereof directed in the front-back direction. The exhaust-side camshaft 42 mainly includes cams 42*a* and an in-shaft oil passage 42*b*.

The cams 42*a* are portions that have a planar shape with a non-uniform distance from the center of rotation, i.e., the center of the exhaust-side camshaft 42, to the outer periphery. Two cams 42*a* are arranged in line at a portion frontward of the portion (the cam journal) of the exhaust-side camshaft 42 placed on the exhaust-side bearing 14 of the cylinder head 10. The cams 42*a* abut the rocker arm 36 on the exhaust valve 34 side from the upper side.

The in-shaft oil passage 42*b* depicted in FIG. 3 is provided in the portion (the cam journal) of the exhaust-side camshaft 42 placed on the exhaust-side bearing 14 of the cylinder head 10 and penetrates the exhaust-side camshaft 42. The in-shaft oil passage 42*b* is configured such that a first end thereof, i.e., one of the openings thereof, opposes the cam journal oil passage 18 in the cylinder head 10 and a second end thereof, i.e., the other opening, faces leftward when the exhaust-side camshaft 42 rotates to a predetermined position.

Although not illustrated in the present embodiment, an oil passage similar to the in-shaft oil passage 42*b* in the exhaust-side camshaft 42 is provided in the intake-side camshaft 40.

The cam caps 50 depicted in FIGS. 1 to 6C are fixedly attached to the upper portion of the cylinder head 10 so as to hold the intake-side camshaft 40 and the exhaust-side camshaft 42 with the cylinder head 10. The cam caps 50 have a substantially rectangular parallelpiped shape with the longitudinal direction thereof directed in the right-left direction.

The cam caps 50 each mainly include an intake-side bearing 52, an intake-side recess 54, an intake-side throughhole 56, an intake-side communicating oil passage 58, an exhaust-side bearing 60, an exhaust-side recess 62, an exhaust-side throughhole 64, and an exhaust-side communicating oil passage 66.

The intake-side bearing 52 depicted in FIGS. 4 to 5, 6B, and 6C rotatably supports the intake-side camshaft 40 from the upper side. The intake-side bearing 52 is provided at a left portion of a cam cap 50 so as to be semicircularly recessed with the lower side open in front view. The intake-side bearing 52 of the cam cap 50 is provided at a position opposing the intake-side bearing 12 of the cylinder head 10, and the intake-side camshaft 40 is rotatably supported (held) between the intake-side bearing 52 and the intake-side bearing 12.

The intake-side recess 54 is one embodiment of the guide portion and the recess according to the present invention, and is provided at a left portion on the upper surface of the cam cap 50, i.e., immediately rightward of the intake-side bearing 52 in the right-left direction. The intake-side recess 54 is configured so as to be recessed downward to a certain depth from the periphery thereof and to be opened at the upper, front, and back sides thereof.

Figure 6A:
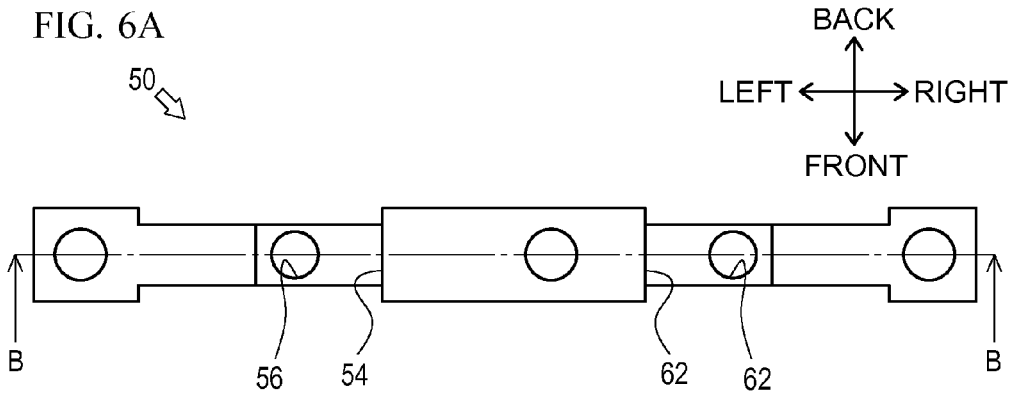
FIG. 6A is a plan view depicting the cam cap.
Figure 6B:
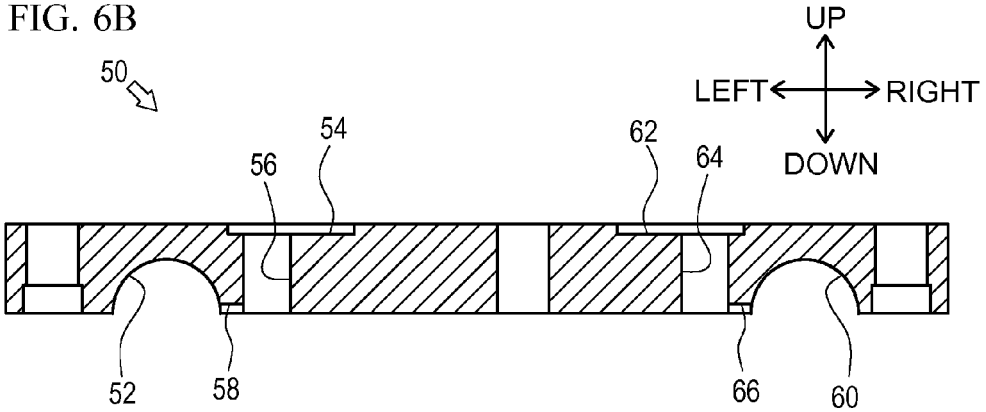
FIG. 6B is a front cross-sectional view depicting a cross section of the cam cap taken along line B-B.
Figure 6C:
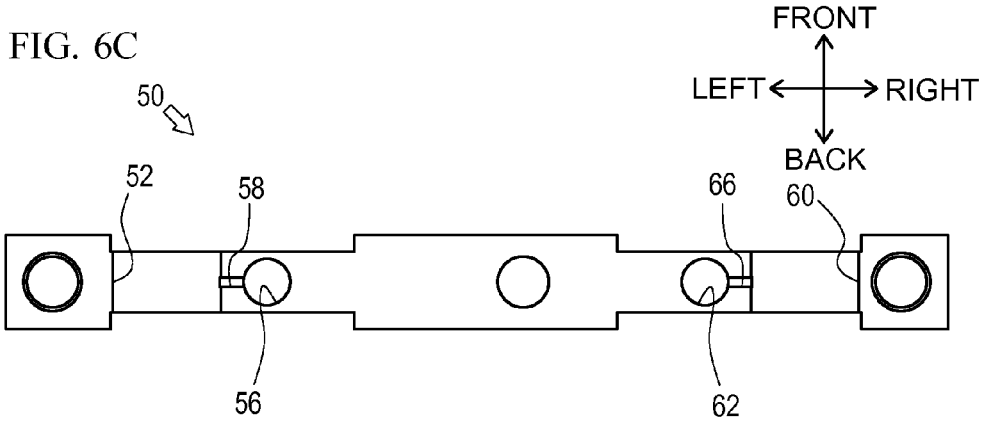
FIG. 6C is a bottom view depicting the cam cap.
Figure 7:
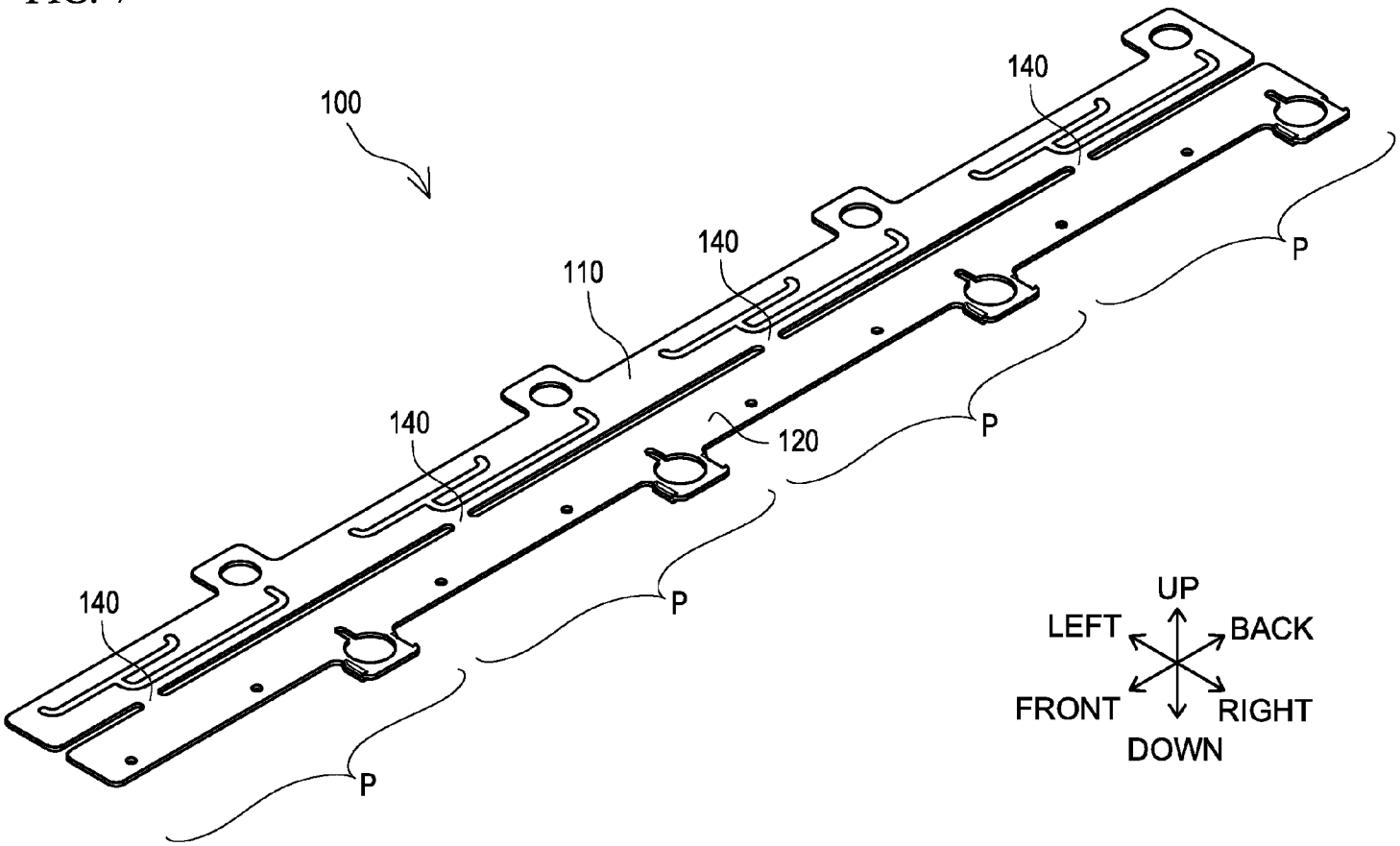
FIG. 7 is a perspective view depicting the oil feed member before folding.
Figure 8A:
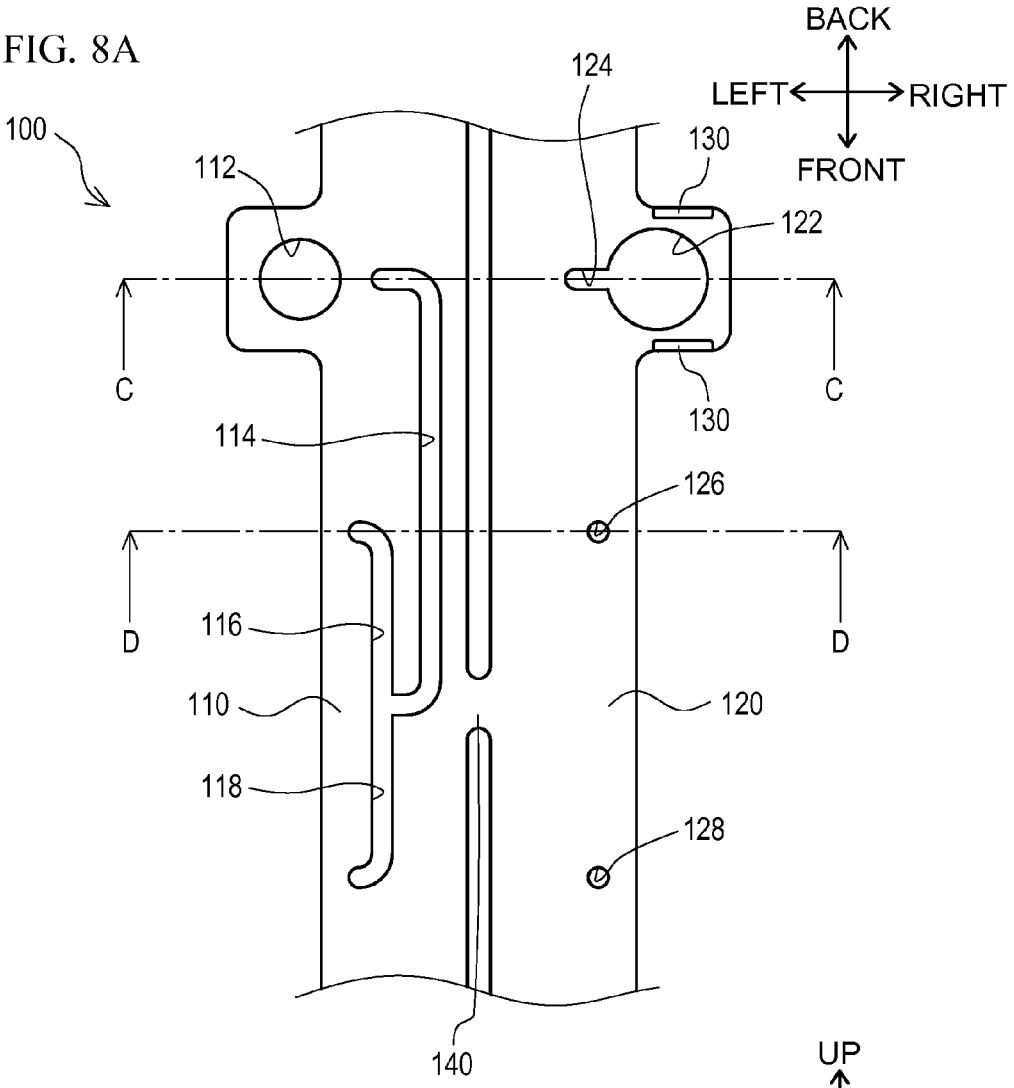
FIG. 8A is an enlarged plan view of the member depicted in FIG. 7.
Figure 8B:
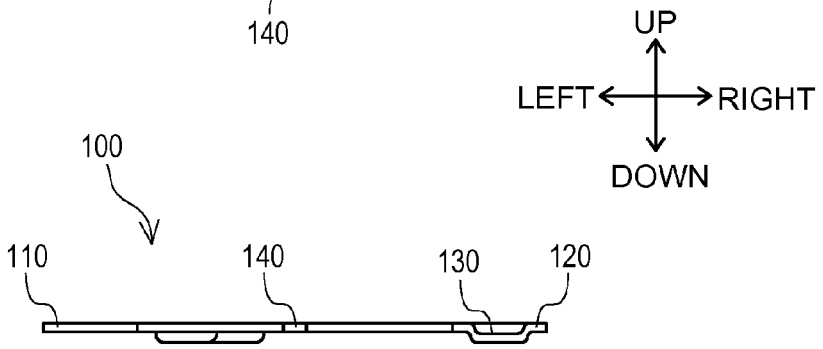
FIG. 8B is a front view of the member depicted in FIG. 7.
Figure 9A:
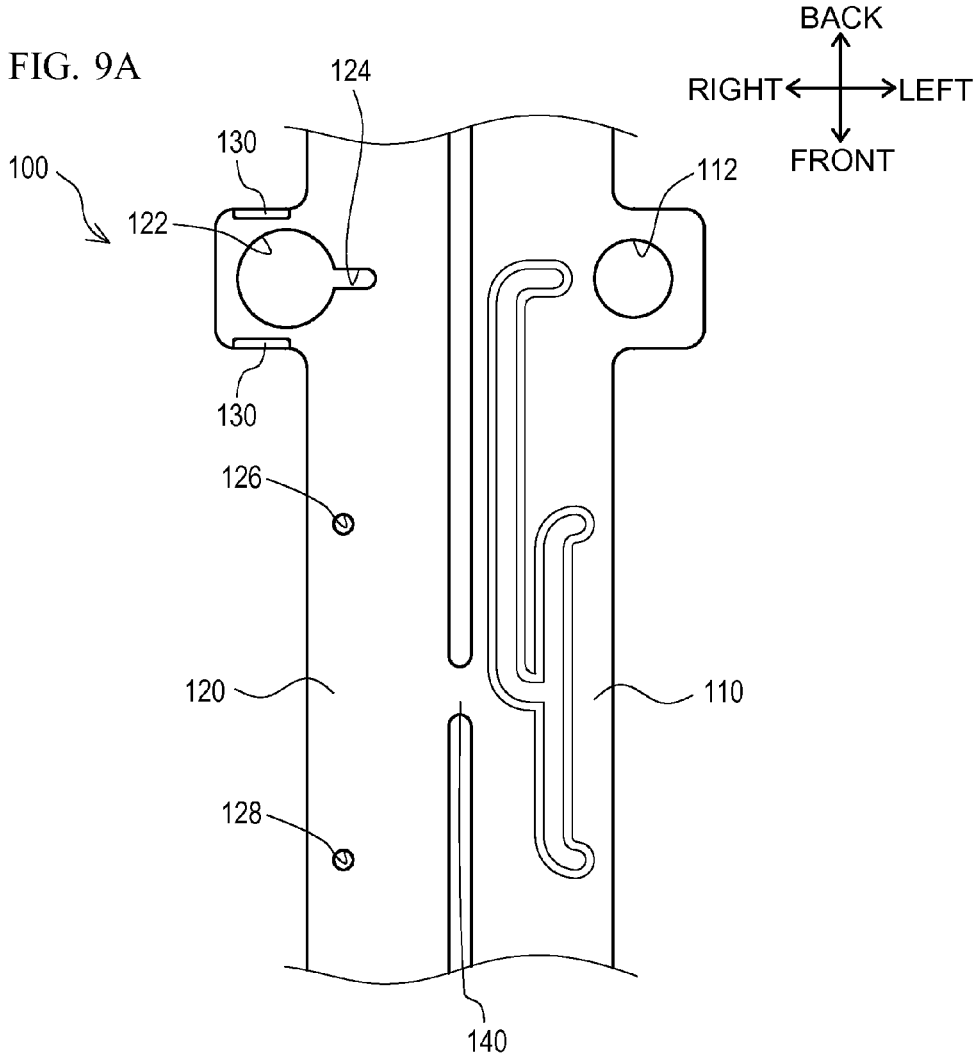
FIG. 9A is an enlarged bottom view of the member depicted in FIG. 7.
Figure 9B:
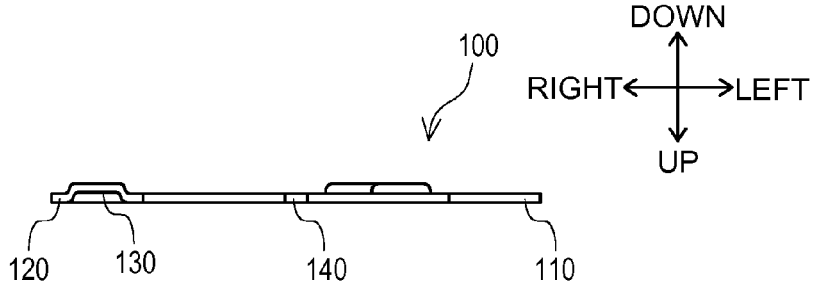
FIG. 9B is a front view of the member depicted in FIG. 7.
Figure 10A:
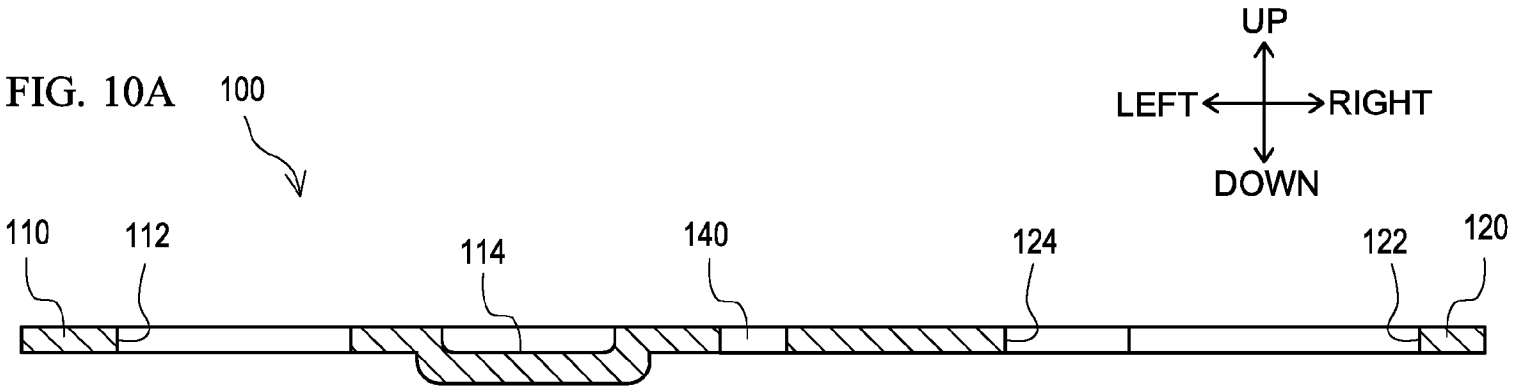
FIG. 10A is a cross-sectional view taken along line C-C in FIG. 8.
Figure 10B:
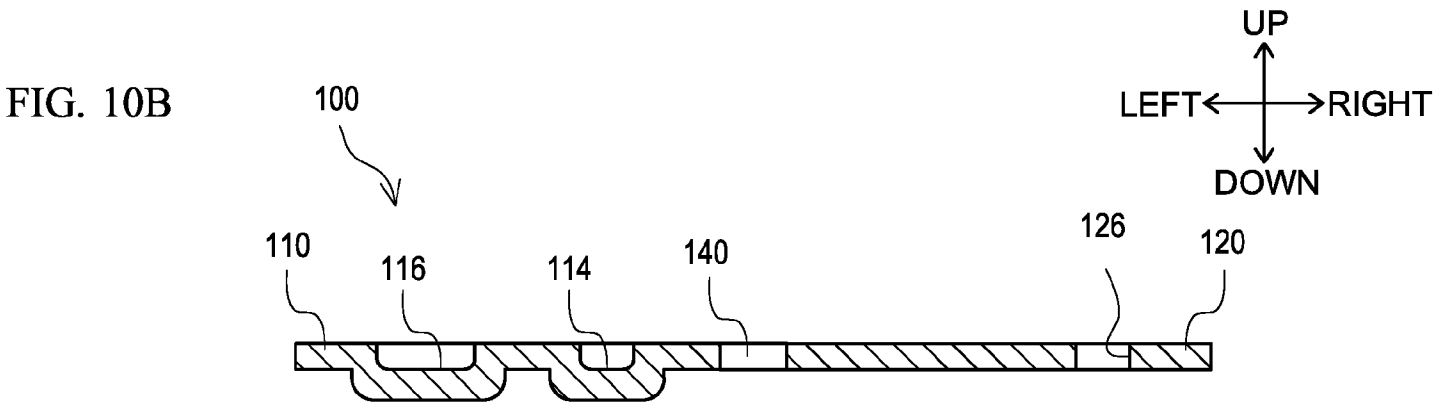
FIG. 10B is a cross-sectional view taken along line D-D in FIG. 8.

The intake-side throughhole 56 depicted in FIGS. 5 to 6C is a bolt opening through which a bolt 150 to be described later is inserted to fixedly attach the cam cap 50 to the cylinder head 10. The intake-side throughhole 56 is provided so as to penetrate from a left portion on the bottom surface of the intake-side recess 54 to the lower surface of the cam cap 50. In other words, the intake-side recess 54 is provided around the upper end of the intake-side throughhole 56. The intake-side throughhole 56 has a diameter that is larger than the diameter of a shaft portion of the bolt 150 to be described later, namely, a diameter that will leave a gap between the intake-side throughhole 56 and the bolt 150 when the shaft portion of the bolt 150 is inserted through the intake-side throughhole 56.

The intake-side communicating oil passage 58 depicted in FIGS. 6B and 6C is configured to communicate the intake-side bearing 52 with the intake-side throughhole 56. The intake-side communicating oil passage 58 is provided at a substantially front-back-wise central portion on the lower surface of the cam cap 50. The intake-side communicating oil passage 58 has a first end communicating with the intake-side bearing 52, and the intake-side communicating oil passage 58 has a second end communicating with the intake-side throughhole 56.

The exhaust-side bearing 60 depicted in FIGS. 3 to 5, 6B, and 6C rotatably supports the exhaust-side camshaft 42 from the upper side. The exhaust-side bearing 60 is provided at a right portion of the cam cap 50 so as to be semicircularly recessed with the lower side open in front view. The exhaust-side bearing 60 of the cam cap 50 is provided at a position opposing the exhaust-side bearing 14 of the cylinder head 10, and the exhaust-side camshaft 42 is rotatably supported (held) between the exhaust-side bearing 60 and the exhaust-side bearing 14.

The exhaust-side recess 62 is one embodiment of the guide portion and the recess according to the present invention, and is provided at a right portion on the upper surface of the cam cap 50, i.e., immediately leftward of the exhaust-side bearing 60 in the right-left direction. The exhaust-side recess 62 is configured so as to be recessed downward to a certain depth from the periphery thereof and to be opened at the upper, front, and back sides thereof.

The exhaust-side throughhole 64 depicted in FIGS. 3, 5, and 6B is a bolt opening through which a bolt 150 to be described later is inserted to fixedly attach the cam cap 50 to the cylinder head 10. The exhaust-side throughhole 64 is provided so as to penetrate from a right portion on the bottom surface of the exhaust-side recess 62 to the lower surface of the cam cap 50. In other words, the exhaust-side recess 62 is provided around the upper end of the exhaust-side throughhole 64. The exhaust-side throughhole 64 has a diameter that is larger than the diameter of the shaft portion of the bolt 150 to be described later, namely, a diameter that will leave a gap between the exhaust-side throughhole 64 and the bolt 150 when the shaft portion of the bolt 150 is inserted through the exhaust-side throughhole 64.

The exhaust-side communicating oil passage 66 depicted in FIGS. 3 to 5, 6B, and 6C is configured to communicate the exhaust-side bearing 60 with the exhaust-side throughhole 64. The exhaust-side communicating oil passage 66 is provided at a substantially front-back-wise central portion on the lower surface of the cam cap 50. The exhaust-side communicating oil passage 66 has a first end communicating with the exhaust-side bearing 60, and the exhaust-side communicating oil passage 66 has a second end communicating with the exhaust-side throughhole 64.

The oil feed members 100 depicted in FIGS. 1 to 5 are configured to guide lubricant to a cam 40*a* of the intake-side camshaft 40 and a cam 42*a* of the exhaust-side camshaft 42.

Since the configuration of the oil feed member 100 for guiding lubricant to a cam 40*a* of the intake-side camshaft 40, i.e., the oil feed member 100 positioned on the left side, is right-left symmetrical with respect to the configuration of the oil feed member 100 for guiding lubricant to a cam 42*a* of the exhaust-side camshaft 42, i.e., the oil feed member 100 positioned on the right side, detailed description is specifically given of the oil feed member 100 positioned on the right side, and description is not given of the oil feed member 100 positioned on the left side.

The oil feed member 100 is formed by folding one panel member. The oil feed member 100 mainly includes a first plate portion 110, a second plate portion 120, and a coupling portion 140.

Although the oil feed member 100 is formed by folding one panel member, the oil feed member 100 before folding is depicted in FIGS. 7 to 10B.

As depicted in FIG. 2, the oil feed member 100 is integrally provided over a plurality of cylinders (four cylinders in the present embodiment) of the engine 1. The oil feed member 100 depicted in FIGS. 7 and 11 includes four portions P arranged in the front-back direction so as to correspond to the four cylinders, respectively. Each portion P has substantially the same shape as one another. Accordingly, description is given below mainly focusing on one portion P of the four portions P of the oil feed member 100.

The first plate portion 110 depicted in FIGS. 7 to 10B is a planar portion configuring an upper portion of the oil feed member 100 after folding. The first plate portion 110 is positioned with the planar surface thereof directed in the up-down direction. The first plate portion 110 has a substantially L-shape in plan view. More specifically, the first plate portion 110 is shaped so as to have a shorter side directed in the right-left direction and a longer side extended from a right end portion of the shorter side toward the front.

The first plate portion 110 mainly includes a throughhole 112, a first oil passage 114, a second oil passage 116, and a third oil passage 118.

The throughhole 112 penetrates the first plate portion 110 in the up-down direction. The throughhole 112 is provided at a position that is in the vicinity of the left end portion of the shorter side of the first plate portion 110.

The first oil passage 114 is one embodiment of an oil passage according to the present invention, and is formed by recessing the upper surface of the first plate portion 110 (the upper surface of the oil feed member 100 before folding as depicted in FIGS. 7 to 10B) so as to guide lubricant. Since the first oil passage 114 is formed by recessing the upper surface of the first plate portion 110, the lower surface of the first plate portion 110 (portion corresponding to the first oil passage 114) projects downward. The first oil passage 114 is extended rightward from a position separated rightward by a predetermined distance from a right end portion of the throughhole 112, is extended frontward from a right end portion to which the passage is extended rightward, and is extended leftward from a front end portion to which the passage is extended frontward.

The second oil passage 116 is one embodiment of an oil passage according to the present invention, and is formed by recessing the upper surface of the first plate portion 110 (the upper surface of the oil feed member 100 before folding as depicted in FIGS. 7 to 10B) so as to guide lubricant. Since the second oil passage 116 is formed by recessing the upper surface of the first plate portion 110, the lower surface of the first plate portion 110 (portion corresponding to the second oil passage 116) projects downward. The second oil passage 116 has a first end communicating with a first end (left front end) of the first oil passage 114. The second oil passage 116 is extended backward from the first end (left front end) of the first oil passage 114, and is extended leftward from a back end portion to which the passage is extended backward.

The third oil passage 118 is one embodiment of an oil passage according to the present invention, and is formed by recessing the upper surface of the first plate portion 110 (the upper surface of the oil feed member 100 before folding as depicted in FIGS. 7 to 10B) so as to guide lubricant. Since the third oil passage 118 is formed by recessing the upper surface of the first plate portion 110, the lower surface of the first plate portion 110 (portion corresponding to the third oil passage 118) projects downward. The third oil passage 118 has a first end communicating with the first end (left front end) of the first oil passage 114. The third oil passage 118 is extended frontward from the first end (left front end) of the first oil passage 114, and is extended leftward from a front end portion to which the passage is extended frontward.

As described above, the second oil passage 116 and the third oil passage 118 are provided so as to branch off from the first end, i.e., the left front end, of the first oil passage 114. Further, the second oil passage 116 and the third oil passage 118 are provided, in plan view, symmetrically in the front-back direction with respect to the axis in the right-left direction that passes the branch point in the first oil passage 114, i.e., the first end of the first oil passage 114. Further, the second oil passage 116 and the third oil passage 118 are configured so as to have an identical cross-sectional shape.

The second plate portion 120 is a planar portion configuring a lower portion of the oil feed member 100 after folding. The second plate portion 120 is positioned with the planar surface thereof directed in the up-down direction. The second plate portion 120 has a substantially L-shape with right-left substantially symmetrical to the first plate portion 110 in plan view. More specifically, the second plate portion 120 is shaped so as to have a shorter side directed in the right-left direction and a longer side extended from a left end portion of the shorter side toward the front.

The second plate portion 120 mainly includes a throughhole 122, a cut-out portion 124, a first discharge port 126, a second discharge port 128, and guide portions 130.

The throughhole 122 penetrates the second plate portion 120 in the up-down direction. The throughhole 122 is provided at a position that is in the vicinity of the right end portion of the shorter side of the second plate portion 120 and overlaps the throughhole 112 in the first plate portion 110 in plan view when the oil feed member 100 is folded (refer to FIG. 13A). The throughhole 122 has a diameter that is larger than the diameter of the shaft portion of the bolt 150 to be described later, namely, a diameter that will leave a gap between the throughhole 122 and the bolt 150 when the shaft portion of the bolt 150 is inserted through the throughhole 122.

The cut-out portion 124 is shaped so as to cut out a left end portion of the throughhole 122 in the second plate portion 120 by a predetermined length in the left direction. The cut-out portion 124 has a left end extending to a position that overlaps the first oil passage 114 on the first plate portion 110 in plan view when the oil feed member 100 is folded (refer to FIG. 13A).

The first discharge port 126 is an aperture that penetrates the second plate portion 120 in the up-down direction for discharging lubricant downward of the second plate portion 120. The first discharge port 126 is provided at a position that overlaps a second end of the second oil passage 116 on the first plate portion 110 in plan view when the oil feed member 100 is folded (refer to FIG. 13B).

The second discharge port 128 is an aperture that penetrates the second plate portion 120 in the up-down direction for discharging lubricant downward of the second plate portion 120. The second discharge port 128 is provided at a position that overlaps a second end of the third oil passage 118 on the first plate portion 110 in plan view when the oil feed member 100 is folded.

The second discharge port 128 has an identical shape (cross-sectional shape) with that of the first discharge port 126.

The guide portions 130 are configured to position the oil feed member 100 with respect to the cam cap 50. The guide portions 130 are formed such that a front portion and a back portion of the shorter side of the second plate portion 120 are recessed downward.

The coupling portion 140 is a portion that couples the first plate portion 110 with the second plate portion 120. The coupling portion 140 is integrally provided with the first plate portion 110 and the second plate portion 120 so as to couple a part of a right end of the first plate portion 110 with a part of a left end of the second plate portion 120.

Description is given below of a manufacturing method for the oil feed member 100.

One panel member is punched by press working, thereby forming an outer shape and a throughhole of the oil feed member 100. Further, the oil feed member 100 is plastically deformed by the next press working, thereby forming an oil passage (the first oil passage 114, the second oil passage 116, and the third oil passage 118), and the guide portions 130 (refer to FIG. 7 and so on).

Figure 11:
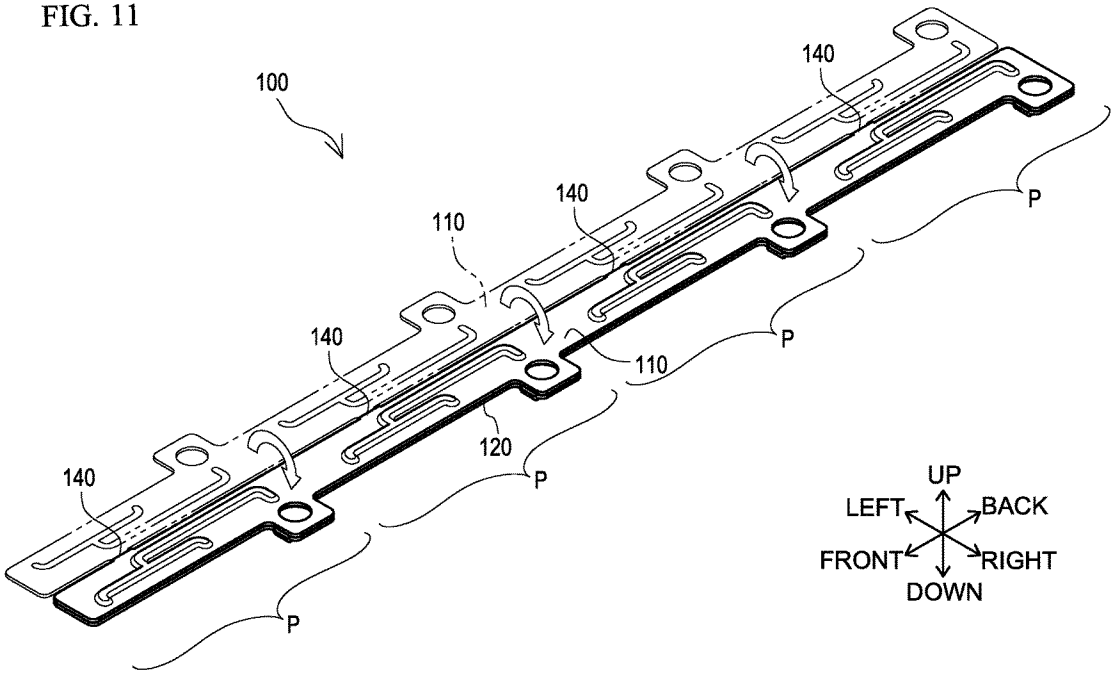
FIG. 11 is a perspective view of the oil feed member after folding.
Figure 12A:
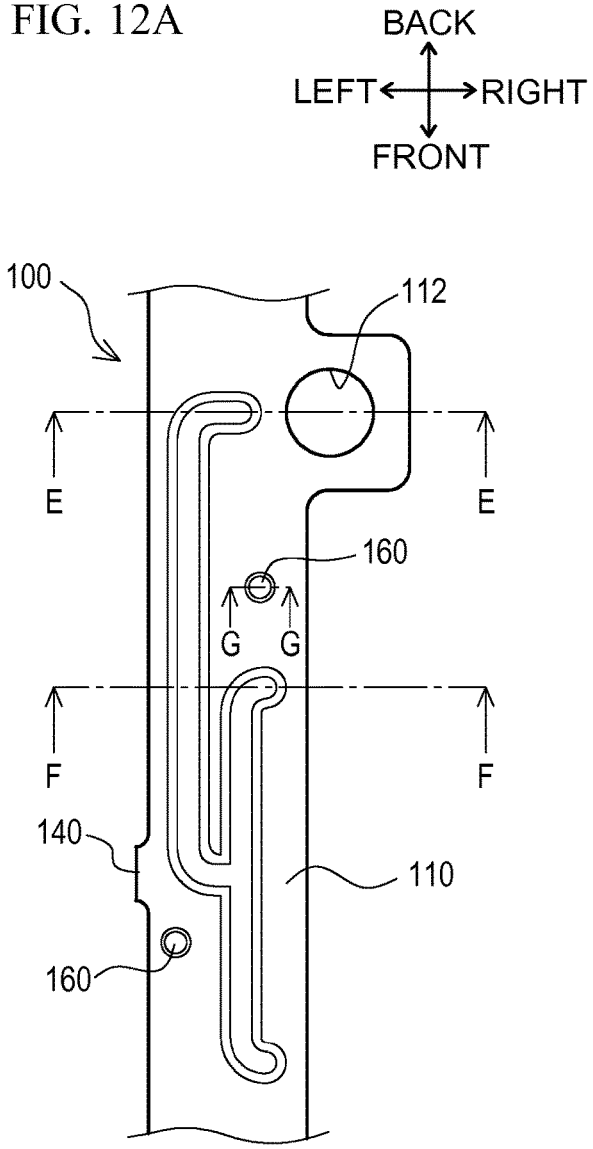
FIG. 12A is an enlarged plan view of the member depicted in FIG. 11.
Figure 12B:
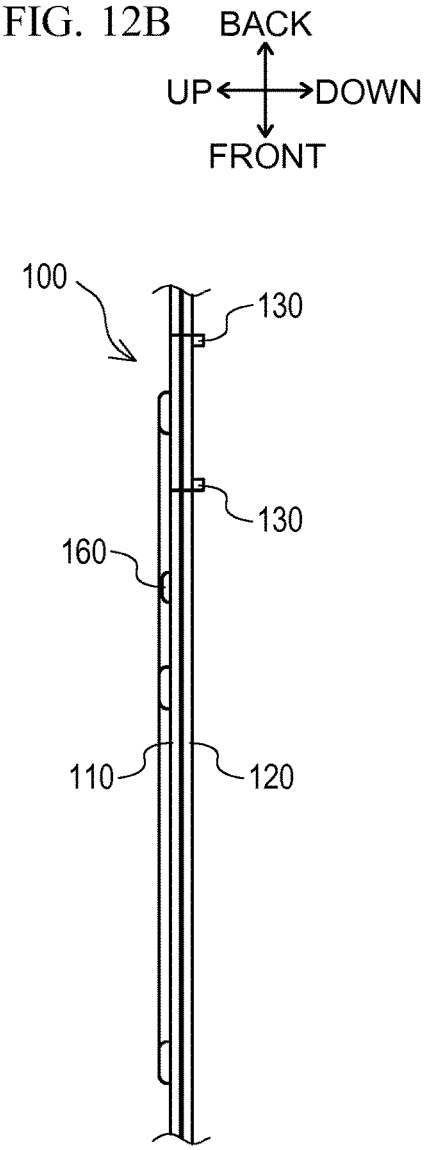
FIG. 12B is a side view of the member depicted in FIG. 11.

The oil feed member 100 is folded such that the first plate portion 110 overlaps the second plate portion 120 centered at four coupling portions 140 (refer to FIG. 11). The oil feed member 100 in the state of being folded is caulked by press working, and holds the first plate portion 110 and the second plate portion 120 in an abutting manner. A caulked portion 160 is provided on a portion that the oil feed member 100 is caulked (refer to FIGS. 12A, 12B, and 13C).

Figure 13A:
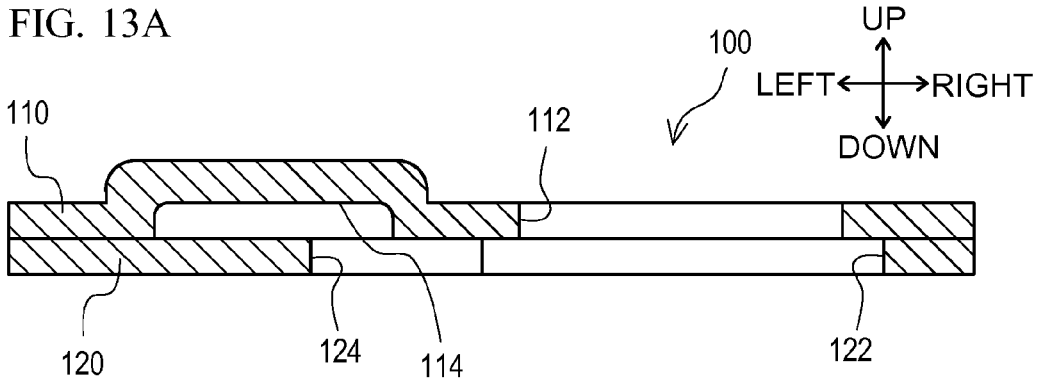
FIG. 13A is a cross-sectional view taken along line E-E in FIG. 12.
Figure 13B:
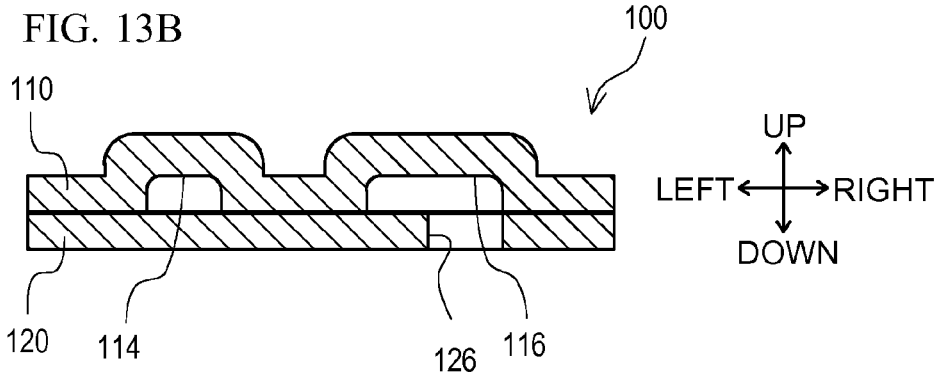
FIG. 13B is a cross-sectional view taken along line F-F in FIG. 12.
Figure 13C:
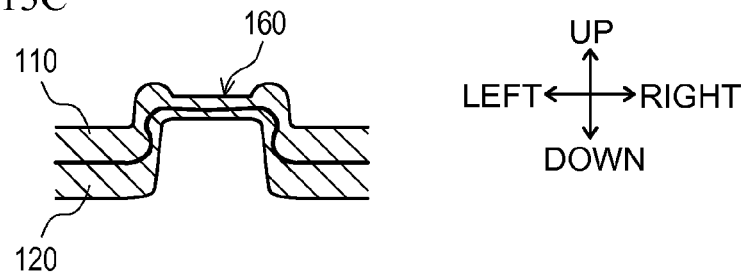
FIG. 13C is a cross-sectional view taken along line G-G in FIG. 12.

In the oil feed member 100 thus manufactured, the throughhole 122 and the cut-out portion 124 in the second plate portion 120 communicate with the first oil passage 114 on the first plate portion 110 (refer to FIG. 13A). The second oil passage 116 on the first plate portion 110 communicates with the first discharge port 126 on the second plate portion 120 (refer to FIG. 13B). Similarly, the third oil passage 118 on the first plate portion 110 communicates with the second discharge port 128 on the second plate portion 120. This permits lubricant to be guided to the first discharge port 126 and the second discharge port 128 through the throughhole 122, the cut-out portion 124, the first oil passage 114, the second oil passage 116, and the third oil passage 118. In other words, the throughhole 122, the cut-out portion 124, the first oil passage 114, the second oil passage 116, the third oil passage 118, the first discharge port 126, and the second discharge port 128 configure an oil passage through which lubricant circulates.

Also as depicted in FIGS. 3 to 5, 14A, and 14B, a portion of the oil feed member 100 (the shorter side portions of the first plate portion 110 and the second plate portion 120) is contained within the exhaust-side recess 62 in the cam cap 50. The throughholes in the oil feed member 100 (the throughhole 112 in the first plate portion 110 and the throughhole 122 in the second plate portion 120) are arranged so as to overlap the exhaust-side throughhole 64 in the cam cap 50 in plan view. The bolt 150 is inserted through the throughholes from the upper side, such that the bolt 150 is fastened to the cylinder head 10. In this manner, the oil feed member 100 is fixedly attached to the cam cap 50 and the cam cap 50 is fixedly attached to the cylinder head 10 by fastening together with the bolt 150.

In so doing, as depicted in FIG. 3, the first oil passage 114 in the oil feed member 100 is provided at a position separated at a predetermined distance from the throughhole 112 through which the bolt 150 is inserted. Accordingly, a portion projected upward in the oil feed member 100, namely the first plate portion 110 in order to form the first oil passage 114, does not interrupt when the bolt 150 is fastened.

Also, in so doing, the thickness of the oil feed member 100, i.e., a total of the thicknesses in the up-down direction of the first plate portion 110 and the second plate portion 120, is set so as to be the same extent as the depth of the exhaust-side recess 62 in the cam cap 50. In the present embodiment, the thickness of the oil feed member 100 is substantially the same as the depth of the exhaust-side recess 62, and only a portion in which the first oil passage 114 is provided is slightly thicker than the depth of the exhaust-side recess 62. Thus, the upper end of the oil feed member 100 hardly project upward from the cam cap 50 in a height-wise direction (in the up-down direction) even after the oil feed member 100 is secured to the cam cap 50 (more precisely, only a portion in which the first oil passage 114 is provided, slightly projects upward from the cam cap 50).

Figure 14A:
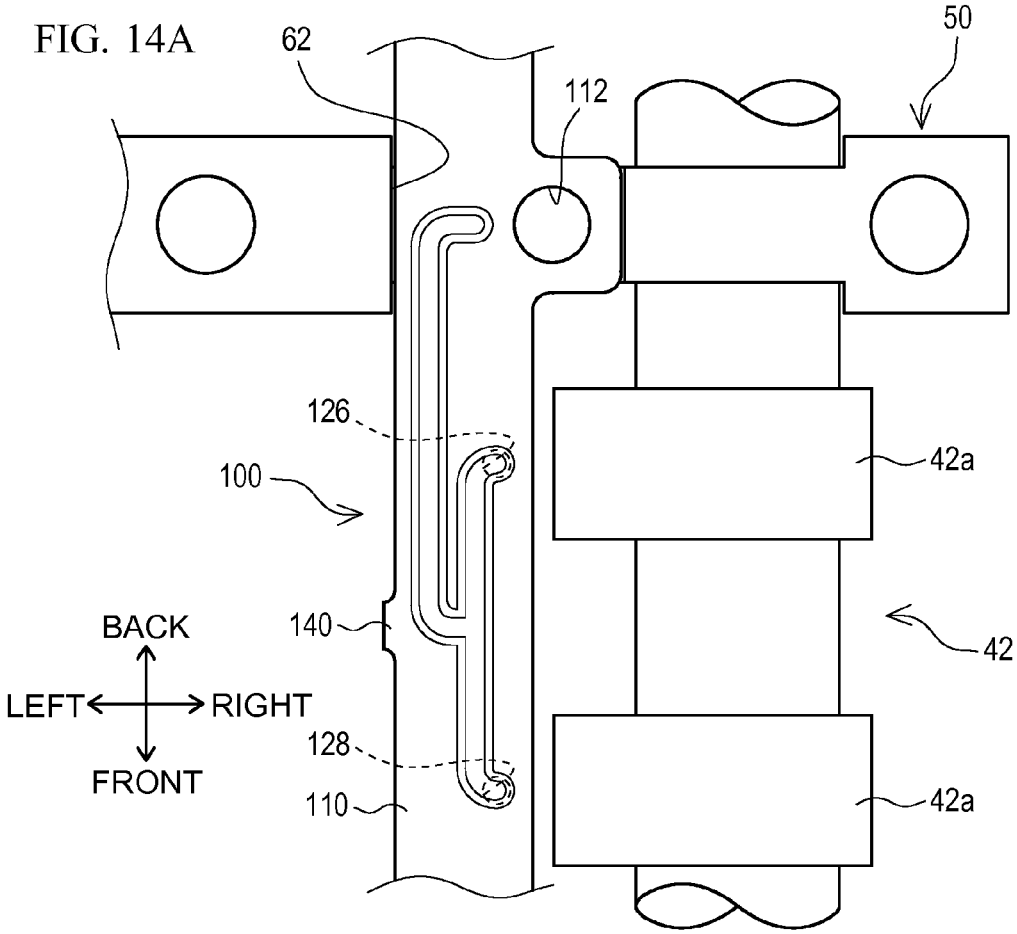
FIG. 14A is an enlarged plan view depicting the cam cap and the oil feed member.
Figure 14B:
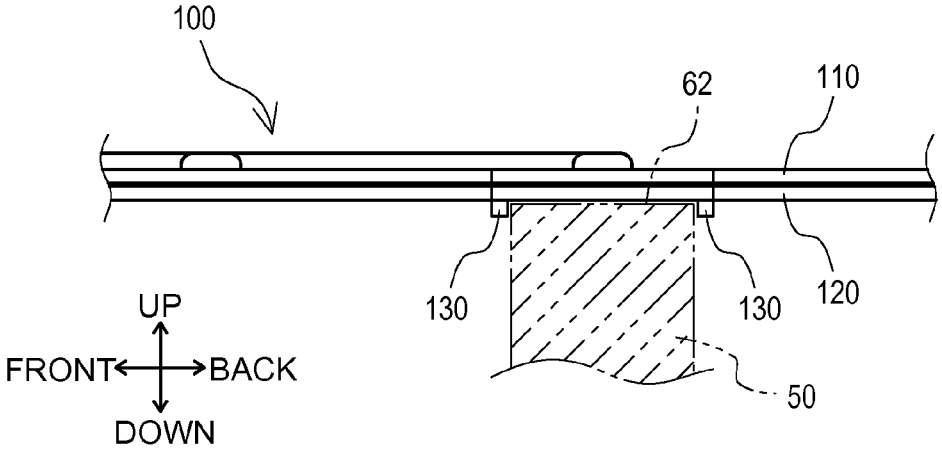
FIG. 14B is an enlarged side view of the member depicted in FIG. 14A.

Further, as depicted in FIGS. 14A and 14B, when a portion of the oil feed member 100 (the shorter side portions of the first plate portion 110 and the second plate portion 120) is contained within the exhaust-side recess 62 in the cam cap 50, the guide portions 130 of the oil feed member 100 and the exhaust-side recess 62 of the cam cap 50 may position the oil feed member 100.

The guide portions 130 of the oil feed member 100 are set such that the guide portions are separated from each other in the front-back direction at substantially the same distance as the front-back width of the cam cap 50. Accordingly, when the oil feed member 100 is contained within the exhaust-side recess 62 in the cam cap 50, the oil feed member 100 may be positioned with respect to the cam cap 50 in the front-back direction by positioning the cam cap 50 to be fitted between the guide portions 130.

Further, the right-left width of the exhaust-side recess 62 in the cam cap 50 is formed so as to be substantially the same as the right-left width of a portion of the oil feed member 100 contained within the exhaust-side recess 62, i.e., the shorter side portions of the first plate portion 110 and the second plate portion 120. Accordingly, the oil feed member 100 is contained within the exhaust-side recess 62 in the cam cap 50, thus allowing the oil feed member 100 to be positioned with respect to the cam cap 50 in the right-left direction.

Further, when the oil feed member 100 is secured to the cam cap 50, as depicted in FIG. 14A, the first discharge port 126 and the second discharge port 128 are each disposed so as to hold the same positions as the cams 42*a* on the exhaust-side camshaft 42 in the front-back direction. Hence, the first discharge port 126 and the second discharge port 128 are each located approximately above the cams 42*a* on the exhaust-side camshaft 42.

Description is given below with reference to FIGS. 15 to 17 of modes of feeding lubricant to the cams 42*a* on the exhaust-side camshaft 42 by using the lubricant feed mechanism for the engine 1 configured as above.

It is to be noted that, since the mode of feeding lubricant to the cams 40*a* on the intake-side camshaft 40 by using the lubricant feed mechanism for the engine 1 is substantially the same, description thereof is not given below.

Figure 15:
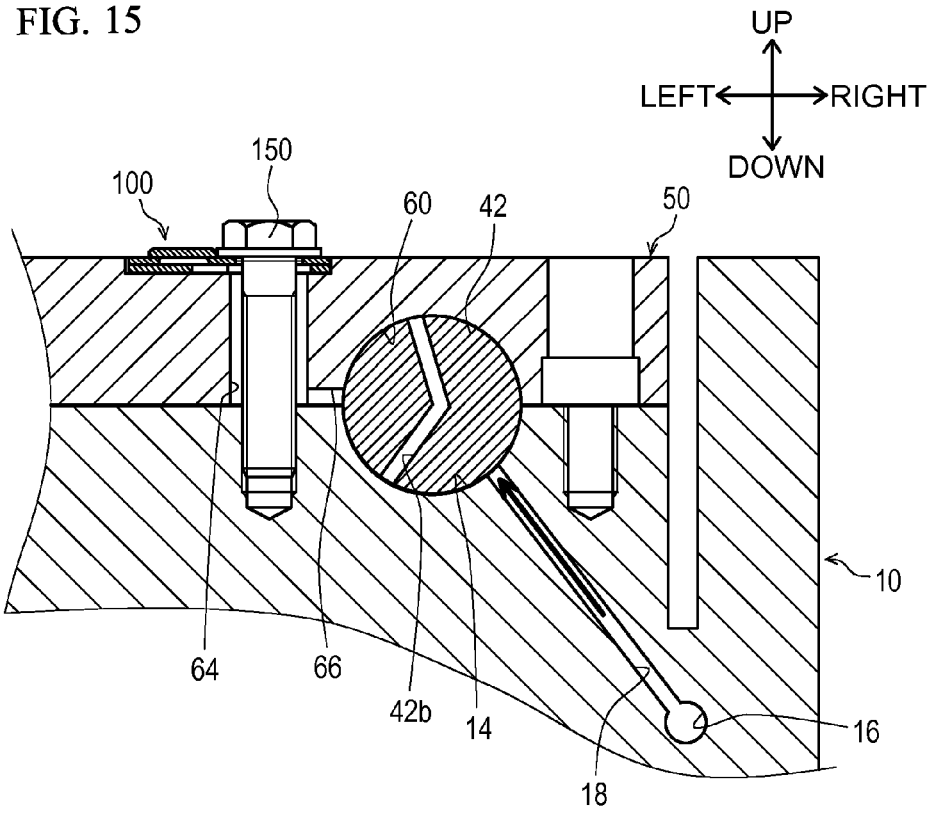
FIG. 15 is a cross-sectional view taken along line A-A in FIG. 2 where lubricant is not fed to an in-shaft oil passage.

As depicted in FIG. 15, the engine 1 is driven to cause the exhaust-side camshaft 42 to rotate, and lubricant circulating through the oil gallery 16 is fed through the cam journal oil passage 18 to the exhaust-side bearing 14 when the first end of the in-shaft oil passage 42*b* does not oppose the cam journal oil passage 18 in the cylinder head 10. The lubricant is not fed into the in-shaft oil passage 42*b* but lubricates the sliding surface between the exhaust-side camshaft 42 and the exhaust-side bearing 14 (and the exhaust-side bearing 60).

Figure 16A:
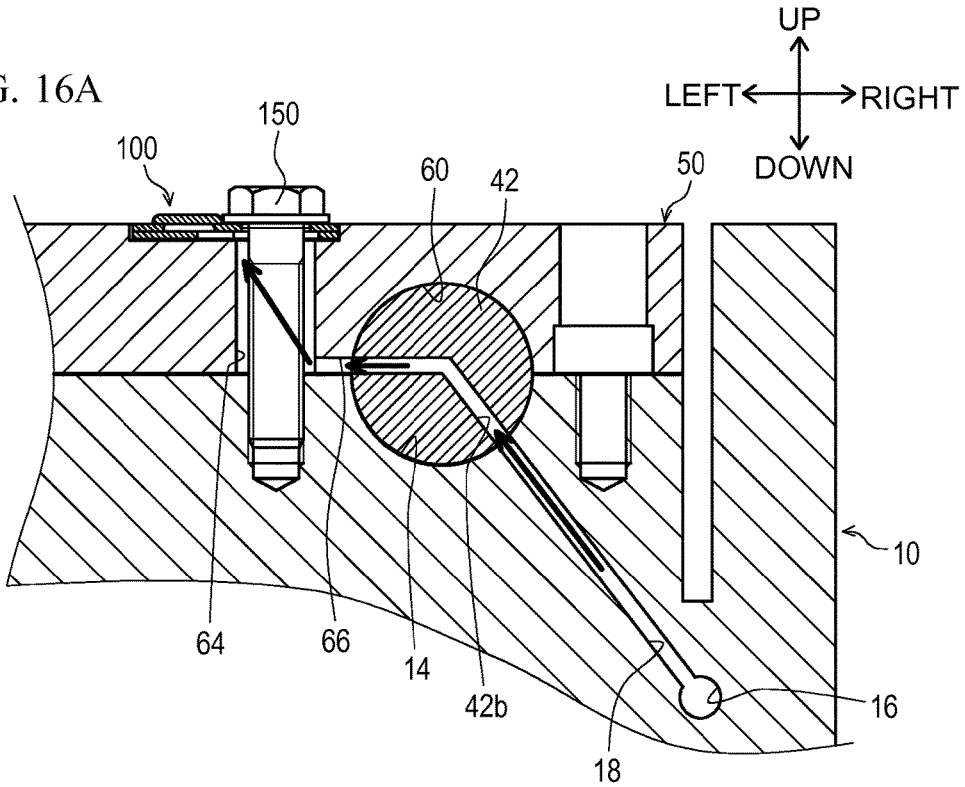
FIG. 16A is a cross-sectional view taken along line A-A in FIG. 2 where lubricant is fed to the in-shaft oil passage.
Figure 17:
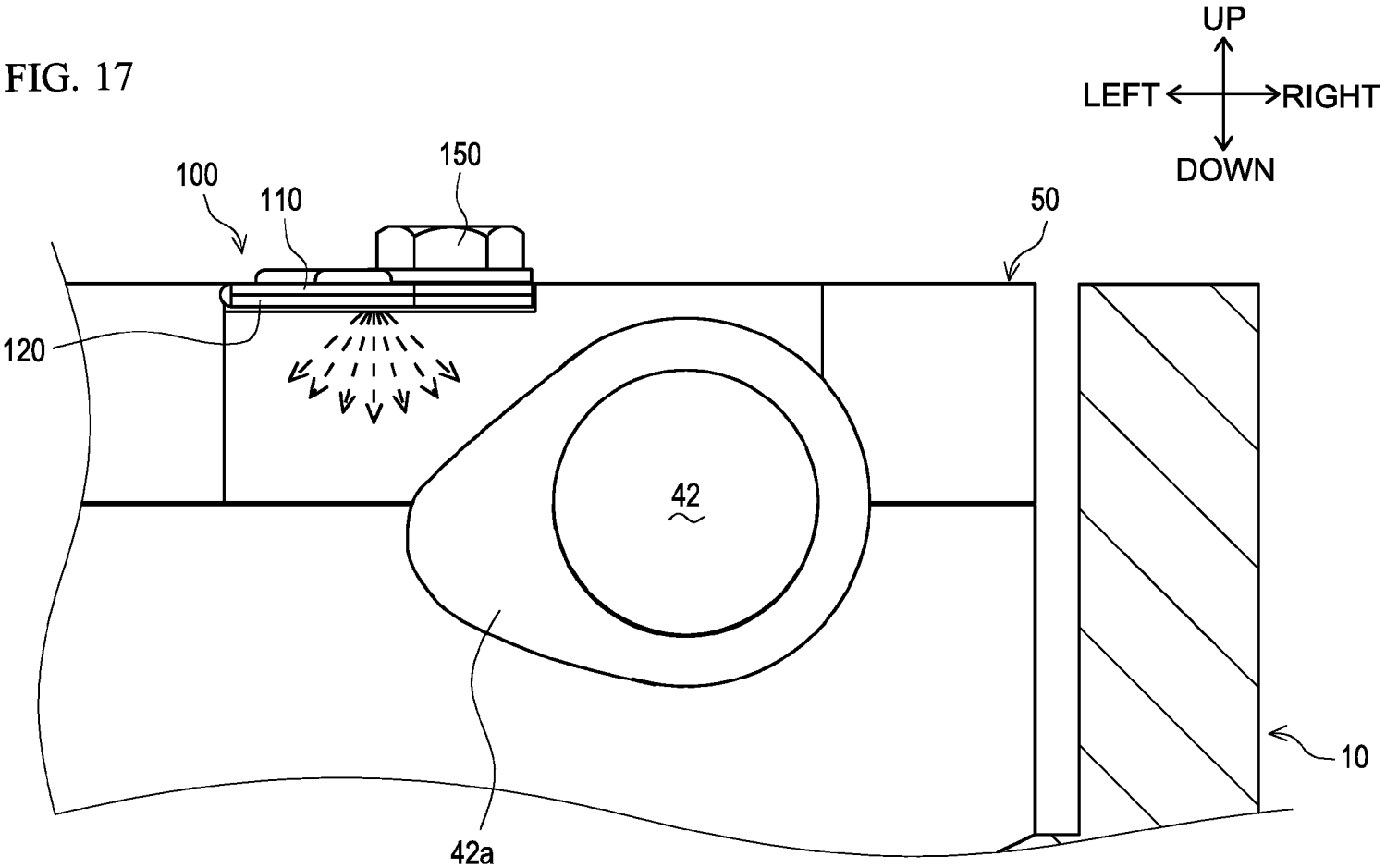
FIG. 17 is a front view showing the way in which lubricant is discharged from the oil feed member to a cam.

As depicted in FIG. 16A, per 360-degree rotation of the exhaust-side camshaft 42, the first end of the in-shaft oil passage 42*b* opposes the cam journal oil passage 18 in the cylinder head 10 once, and the second end of the in-shaft oil passage 42*b* also opposes the exhaust-side communicating oil passage 66. In this case, lubricant flowing in the oil gallery 16 is fed through the cam journal oil passage 18 into the in-shaft oil passage 42*b*. Further, the lubricant is fed through the in-shaft oil passage 42*b* and the exhaust-side communicating oil passage 66 into the exhaust-side throughhole 64. The bolt 150 is inserted through the exhaust-side throughhole 64, while a gap is provided between the exhaust-side throughhole 64 and the bolt 150, thus allowing the lubricant to circulate inside the exhaust-side throughhole 64. The lubricant flows upward in the exhaust-side throughhole 64 and is fed to the oil feed member 100, more specifically, into the throughhole 122 in the second plate portion 120.

Figure 16B:
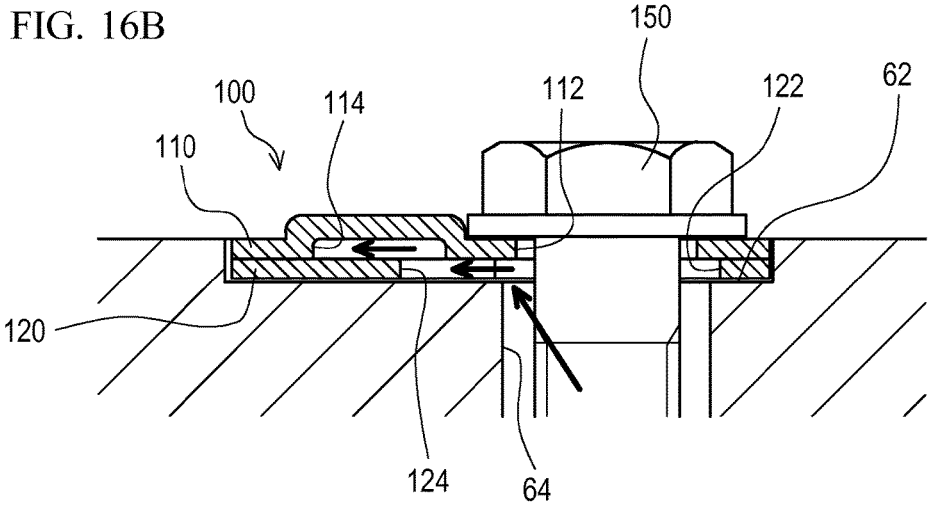
FIG. 16B is an enlarged cross-sectional view taken along line A-A in FIG. 2 where lubricant is fed to the in-shaft oil passage.

As depicted in FIG. 16B, lubricant fed to the throughhole 122 in the second plate portion 120 flows through the cut-out portion 124 into the first oil passage 114 in the first plate portion 110. The lubricant fed to the first oil passage 114 is fed being branched to the second oil passage 116 and the third oil passage 118 (see, for example, FIG. 8A). The lubricant fed to the second oil passage 116 is discharged downward through the first discharge port 126. The lubricant fed to the third oil passage 118 is discharged downward through the second discharge port 128. As indicated by the broken line in FIG. 17, the lubricant discharged from the first discharge port 126 and the second discharge port 128 in the oil feed member 100 is fed to the cams 42*a* that are arranged at the lower side of the first discharge port 126 and the second discharge port 128, thus lubricating the cams 42*a*.

In this manner, lubricant is fed to the cams 42*a* when the exhaust-side camshaft 42 rotates by a predetermined angle. More specifically, lubricant is fed intermittently, i.e., once during one rotation of the exhaust-side camshaft 42, to the cams 42*a*. Thus, lubricant is not fed constantly to the cams 42*a*, which allows for prevention of excessive feeding of lubricant to the cams 42*a*.

The second oil passage 116 and the third oil passage 118 are provided so as to be symmetrical in the front-back direction in plan view and to have an identical cross-sectional shape. More specifically, the second oil passage 116 and the third oil passage 118 are configured to have the same length, the same cross-sectional shape, the same number of turns, and the same angle of turning. With this configuration, the lubricant fed from the first oil passage 114 has a substantially equal pressure loss in flowing the second oil passage 116 and the third oil passage 118; thus, the flow rate of lubricant is substantially the same in the second oil passage 116 and in the third oil passage 118. Hence, a substantially equal amount of lubricant can be fed to the cams 42*a*.

As above, the lubricant feed mechanism for the engine 1 according to the present embodiment is configured to feed lubricant to a cam (a cam 40*a* and a cam 42*a*) of the valve gear 30 through the cylinder head 10, a camshaft (an intake-side camshaft 40 and an exhaust-side camshaft 42), a cam cap 50, and an oil feed member 100. The oil feed member 100 is formed by folding one panel member, and the inside surface of the oil feed member 100 in the folded state is recessed so as to form an oil passage (a first oil passage 114, a second oil passage 116, and a third oil passage 118) for guiding lubricant fed through the cam cap 50 to the cam.

This configuration allows for forming of the oil feed member 100 by press working only, and thus reduction of the manufacturing cost is achieved. Further, since the oil passage is formed by recessing the inside surface, the oil passage is usable as a reinforcing member (rib) of the oil feed member 100, thus allowing the oil feed member 100 to increase the rigidity thereof. Further, since the oil passage may increase the rigidity of the oil feed member 100, the thickness of the oil feed member 100 may be made thinner.

The oil feed member 100 is integrally provided over the plurality of cylinders of the engine 1.

This configuration allows for the reduction of the manufacturing cost compared to the case where an oil feed member is separately provided per cylinder. Further, the oil feed member 100 is integrally provided over the plurality of cylinders, thus allowing the oil feed member 100 to increase the rigidity thereof. Further, since the oil feed member 100 is supported by a plurality of cam caps 50, i.e., a plurality of fulcrums, the oil feed member 100 may be prevented from being swung by the vibration of the engine 1. With this configuration, positions of the first discharge port 126 and the second discharge port 128 in the oil feed member 100 are stabilized, and thus the lubricant may be surely fed to the cams 40*a* and the cams 42*a*.

Further, the oil feed member 100 has a portion deformed plastically to thereby form the guide portions 130 for positioning the oil feed member 100 with respect to the cam cap 50.

With this configuration, attachment work of the oil feed member 100 can be facilitated with respect to the cam cap 50. Further, since the guide portions 130 can also be formed by press working, the increase of the manufacturing cost is suppressed.

The cam cap 50 has a guide portion (an intake-side recess 54 and an exhaust-side recess 62) for positioning the cam cap 50 with respect to the oil feed member 100.

With this configuration, attachment work of the oil feed member 100 is facilitated with respect to the cam cap 50.

The oil feed member 100 is fastened together with the cam cap 50 and then fixed to the cylinder head 10.

This configuration allows for the reduction of the number of the fastening members such as a bolt, and for the reduction of the manufacturing cost.

The cam cap 50 has a recess (an intake-side recess 54 and an exhaust-side recess 62). The oil feed member 100 has a portion contained within the recess of the cam cap 50 and is disposed in the cam cap 50.

This configuration allows for feeding of lubricant to the cam without using the space above the cam cap 50. In this manner, interference among members is prevented, and design changes to avoid the interference are obviated.

The oil passage provided in the oil feed member 100 has a plurality of branches from a middle portion thereof, i.e., branches from the first oil passage 114 to the second oil passage 116 and the third oil passage 118, and has a plurality of discharge ports, i.e., the first discharge port 126 and the second discharge port 128, for feeding lubricant to the cam.

With this configuration, the lubricant can be fed from the plurality of discharge ports (the first discharge port 126 and the second discharge port 128) to the cams (a cam 40*a* and a cam 42*a*). Hence, the lubricant can simultaneously be fed to a plurality of cams. Further, when the positions of the discharge ports are changed, the lubricant can also be fed from the plurality of discharge ports to a cam.

Further, the branched oil passages (the second oil passage 116 and the third oil passage 118) are configured to have the same length, the same cross-sectional shape, the same number of turns, and the same angle of turning.

With this configuration, the same amount of the lubricant can be fed to the plurality of branched oil passages. Hence, the same amount of the lubricant can be discharged from the discharge ports (the first discharge port 126 and the second discharge port 128) that are formed to correspond to ends of the plurality of branched oil passages.

It is to be noted that, while the engine 1 according to the present embodiment is described as an inline 4-cylinder DOHC 16-valve gasoline engine, engines to which the present invention is applicable are not limited thereto.

Further, while in the present invention, the oil gallery 16, the cam journal oil passage 18, the in-shaft oil passage 42*b*, the exhaust-side communicating oil passage 66, and the exhaust-side throughhole 64 are provided so as to guide the lubricant, the shapes thereof are not limited to the present embodiment. These shapes may be determined arbitrarily.

Further, the shapes of each portion P of the oil feed member 100 are not limited to the substantially L-shape in plan view as in the present embodiment, and the shapes may be any shape insofar as lubricant is feedable to the cams, i.e., a cam 40*a* and a cam 42*a*.

Further, while in the present embodiment, the oil feed member 100 is formed by folding one panel member, it is also conceivable that a seal member such as a gasket is interposed between panel members in the folded state.

Further, while in the present embodiment, the oil passage in the oil feed member 100 branches into two, i.e., the second oil passage 116 and the third oil passage 118, from a middle portion thereof, i.e., the first oil passage 114, the present invention is not limited thereto. More specifically, the oil passages in the oil feed member 100 may take a configuration of branching into two from an upstream end portion thereof, namely, the configuration in which two oil passages are provided from the beginning and not one oil passage branches from a middle portion.

Further, while in the present embodiment, the second oil passage 116 and the third oil passage 118 are configured to be symmetrical in the front-back direction, the present invention is not limited thereto. More specifically, it is also conceivable that the second oil passage 116 and the third oil passage 118 are shaped to be asymmetrical, i.e., shapes having lengths, cross-sectional shapes, numbers of turns, and angles of turning that are different from each other. In this manner, the second oil passage 116 and the third oil passage 118 are shaped to be arbitrary, such that the flow rates of the lubricant circulating into the oil passages is adjusted.

Further, while a caulked portion, i.e., the caulked portion 160, is caulked by press working so as to hold the oil feed member 100 in the folded state (refer to FIGS. 12A, 12B, and 13C), the position and the number of the caulked portion are not limited to the present embodiment. For example, in case where the oil feed member 100 has many caulked portions in the vicinity of the oil passages, oil leakage from the oil passages is suppressed.

Further, materials of panel member for forming the oil feed member according to the present invention are not limited to metal or resin, the materials may be any materials insofar as one panel member is foldable to form the oil feed member.

Figure 18:
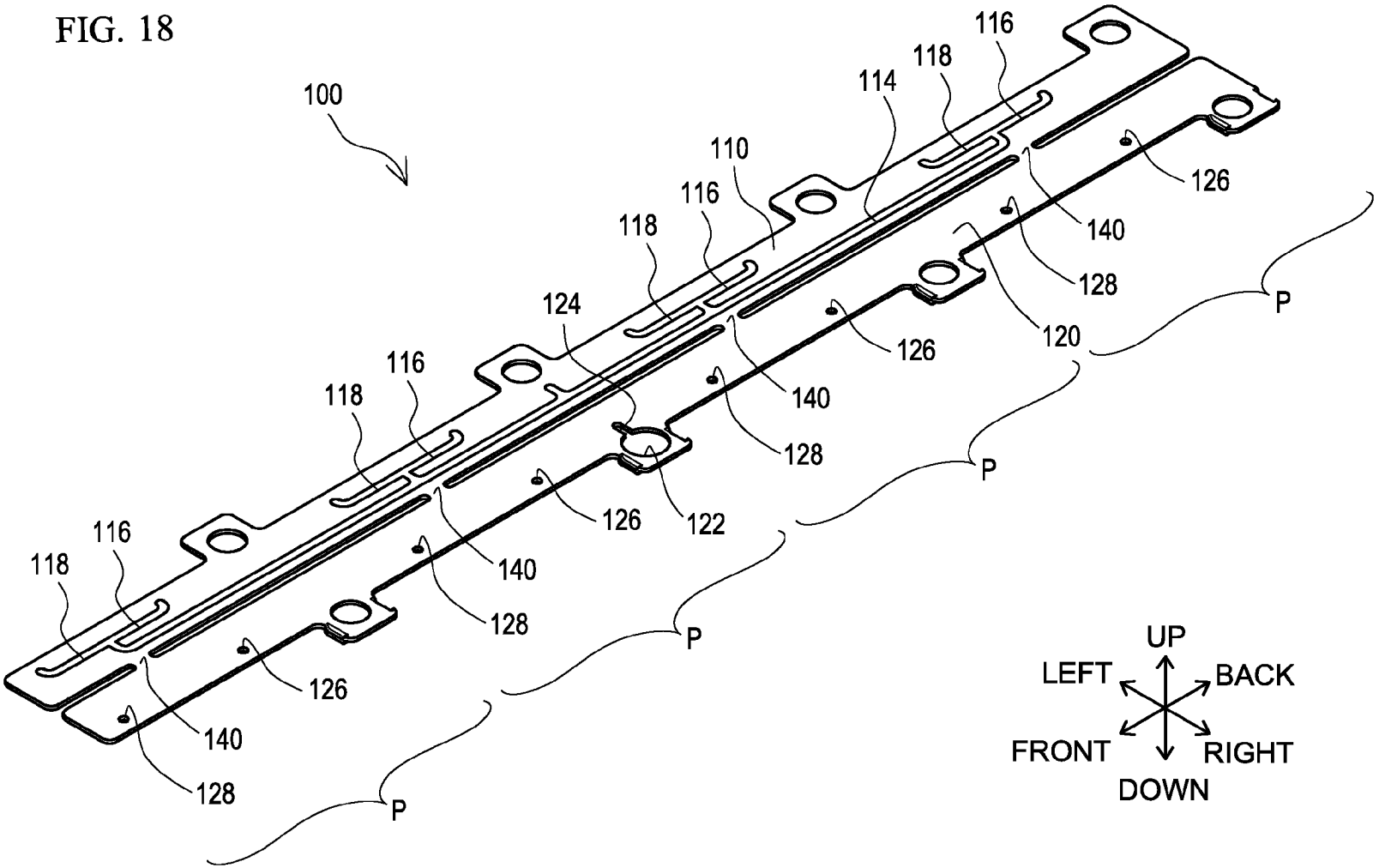
FIG. 18 is a perspective view of an oil feed member according to a second embodiment.

As depicted in FIG. 18 (a second embodiment), it is conceivable that a plurality of the first oil passage 114 provided on each portion P of the oil feed member 100 are coupled to be one linear form. In this case, the first oil passage 114 with one linear form is configured to be fed with the lubricant through the throughhole 122 and the cut-out portion 124 that are provided at one portion. Thus, the configuration of the lubricant feed mechanism for the engine 1 may be simplified and reduction of the manufacturing cost is achieved. Further, the throughhole 122 and the cut-out portion 124, which are provided at one portion, are provided at a substantially center of the oil feed member 100 in the front-back direction. Thus, the lubricant may be fed through whole of the oil passage as uniformly as possible.

Figure 19A:
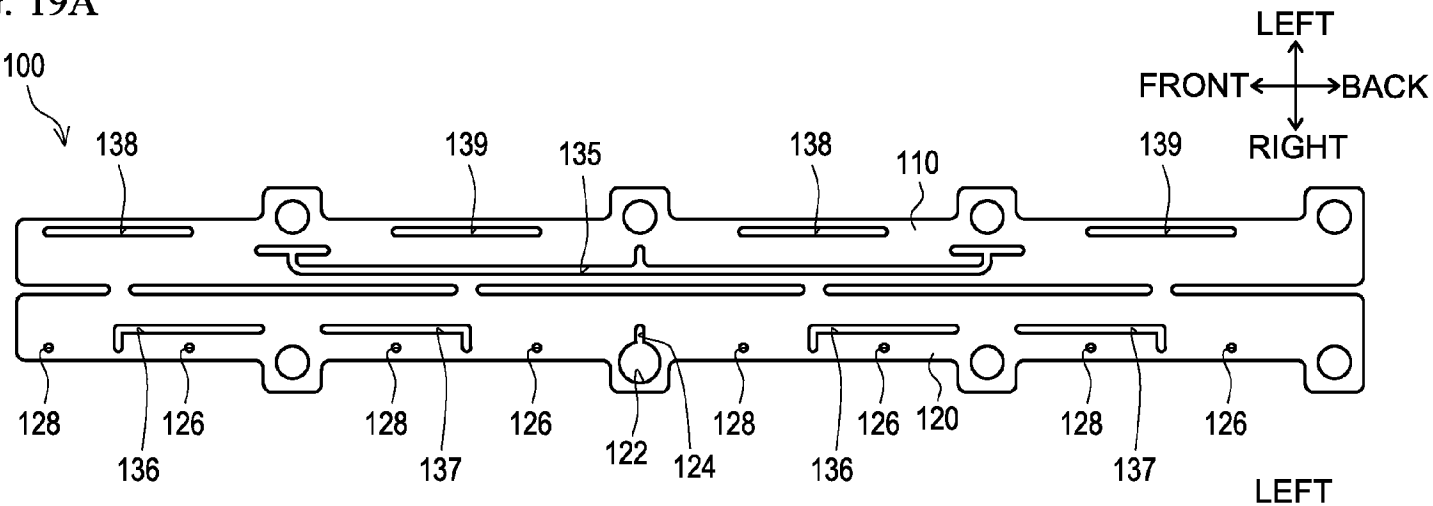
FIG. 19A is a plan view showing the status before an oil feed member according to a third embodiment is folded.
Figure 19B:
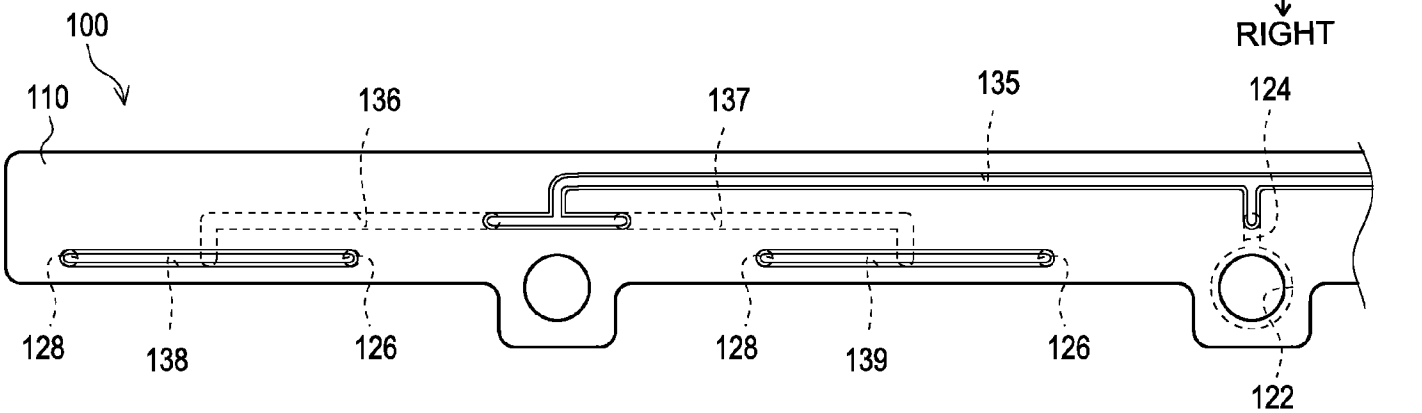
FIG. 19B is an enlarged plan view showing the status after the member depicted in FIG. 19A is folded.

As depicted in FIGS. 19A and 19B (a third embodiment), it is also conceivable that oil passages of the oil feed member 100 are divided into the first plate portion 110 and the second plate portion 120, and thereby space for the layout of the oil passages may be saved.

More specifically, a first oil passage 135 is provided on the first plate portion 110 such that the lubricant is fed through the throughhole 122 and the cut-out portion 124. A second oil passage 136 and a third oil passage 137 are provided on the second plate portion 120 such that the lubricant fed through the first oil passage 135 is branched in the front-back direction. A fourth oil passage 138 and a fifth oil passage 139 are provided on the first plate portion 110 such that the lubricant fed through the second oil passage 136 and the third oil passage 137 is further branched in the front-back direction, and that the lubricant is guided to the first discharge port 126 and the second discharge port 128. Thus, a plurality of oil passages extended in the front-back direction are alternately provided on the first plate portion 110 and the second plate portion 120, and thereby intervals between the oil passages (intervals in the right-left direction in the present embodiment) on each plate portion (the first plate portion 110 and the second plate portion 120) may be ensured widely. Hence, press working may be easily performed and intervals between the oil passages may be further narrowed. Further, the space where the oil passage is provided, i.e., the width in the right-left direction in the present embodiment may be saved.

Figure 20A:
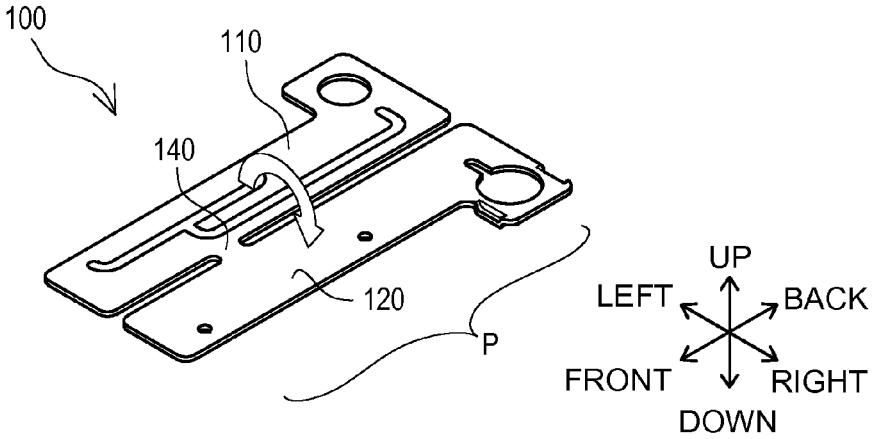
FIG. 20A is a perspective view of an oil feed member according to a fourth embodiment.

As depicted in FIG. 20A (a fourth embodiment), it is also conceivable that the oil feed member 100 is configured to be divided into each individual portion P. Specifically, the present invention is not limited to the configuration in which the oil feed member 100 is integrally provided over the plurality of cylinders of the engine 1.

Figure 20B:
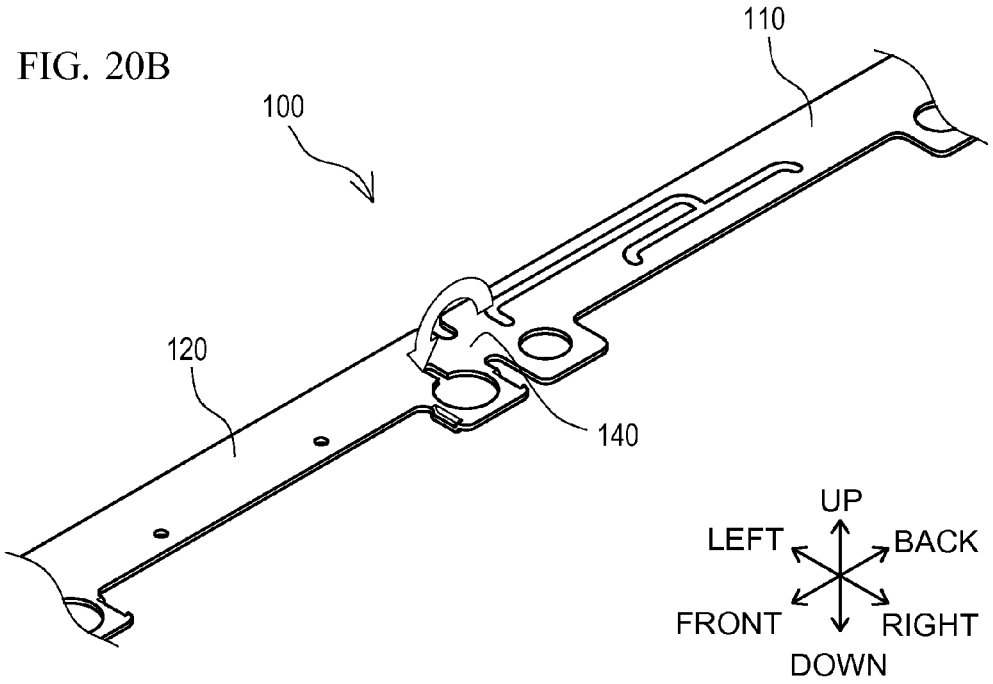
FIG. 20B is a perspective view of an oil feed member according to a fifth embodiment.
Figure 21A:
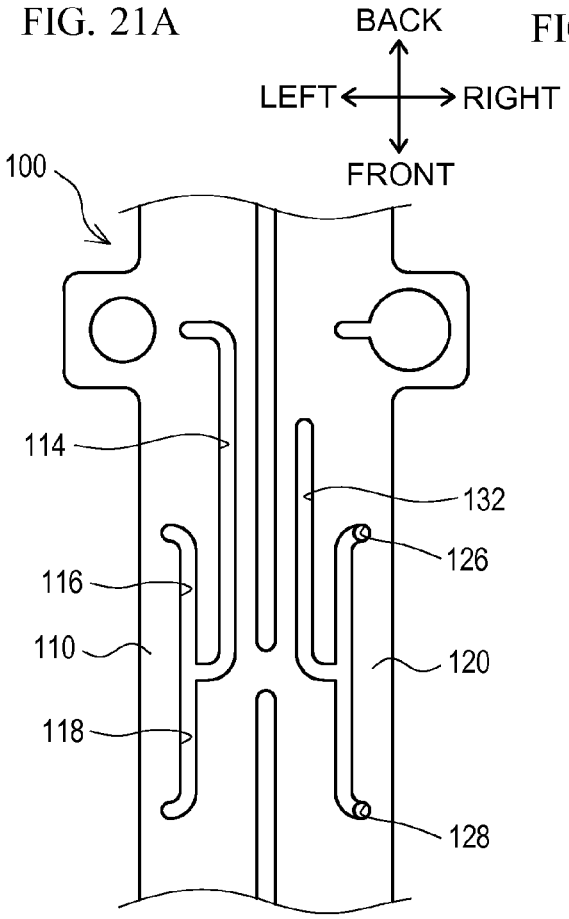
FIG. 21A is a plan view depicting an oil feed member, before folding, according to a sixth embodiment.
Figure 21C:
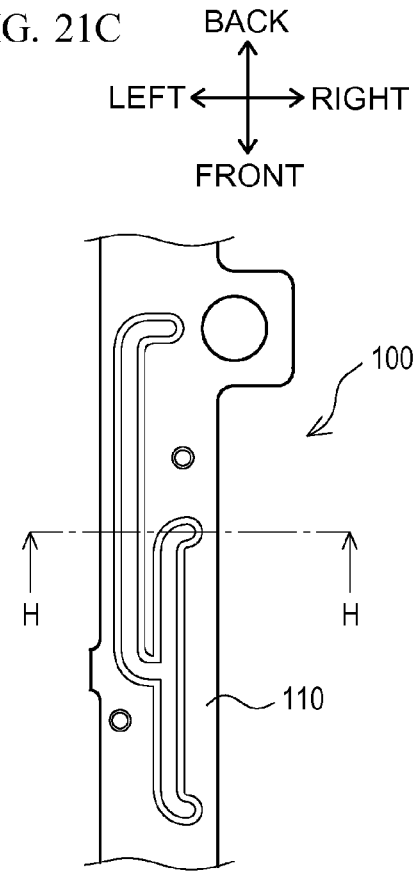
FIG. 21C is a plan view depicting the oil feed member, after folding, according to the sixth embodiment.
Figure 21B:
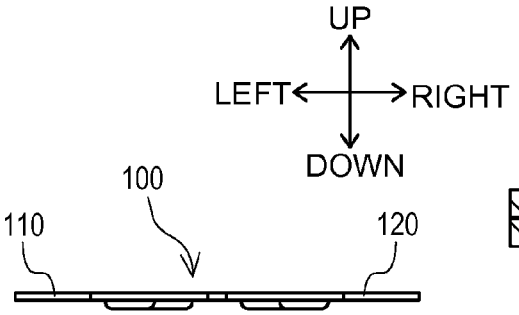
FIG. 21B is a front view of the member depicted in FIG. 21A.
Figure 21D:
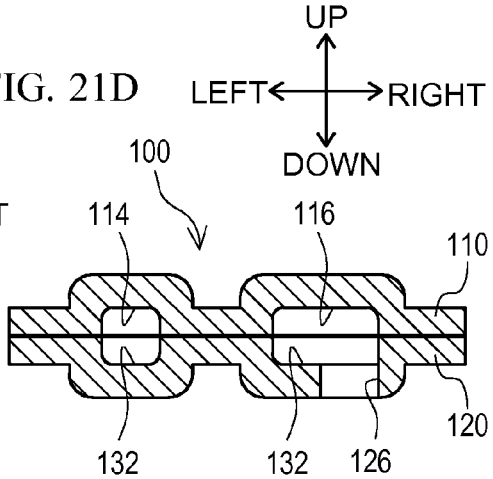
FIG. 21D is a cross-sectional view taken along line H-H in FIG. 21C.

As depicted in FIG. 20B (a fifth embodiment), it is also conceivable that the oil feed member 100 is configured to arrange the first plate portion 110 and the second plate portion 120 in line in the front-back direction and to couple the first plate portion 110 and the second plate portion 120 with the coupling portion 140, and such that the oil feed member 100 is formed by folding in the front-back direction centered at the coupling portion 140. Hence, in the present invention, the folding direction of the oil feed member 100 is not limited.

As depicted in FIGS. 21A to 21D (a sixth embodiment), it is also conceivable that an oil passage 132 is provided on the second plate portion 120 of the oil feed member 100 so as to oppose the first oil passage 114, the second oil passage 116, and the third oil passage 118 that are provided on the first plate portion 110. Thus, the oil passages are provided not only on the first plate portion 110 but also on the second plate portion 120, thus allowing the lubricant to circulate through the oil passages smoothly. Further, the oil passage 132 is also usable as a reinforcing member (rib) of the oil feed member 100, thus allowing the oil feed member 100 to further increase the rigidity thereof.

Figure 22A:
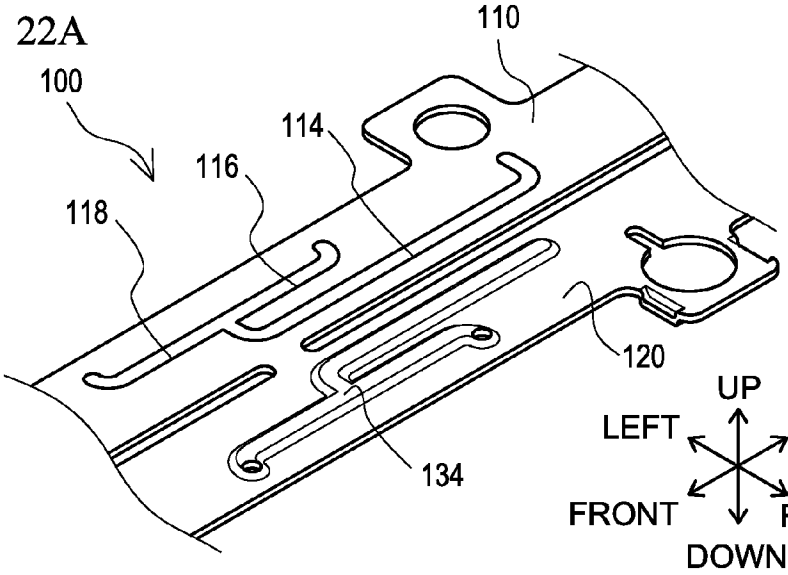
FIG. 22A is a perspective view depicting an oil feed member, before folding, according to a seventh embodiment.
Figure 22B:
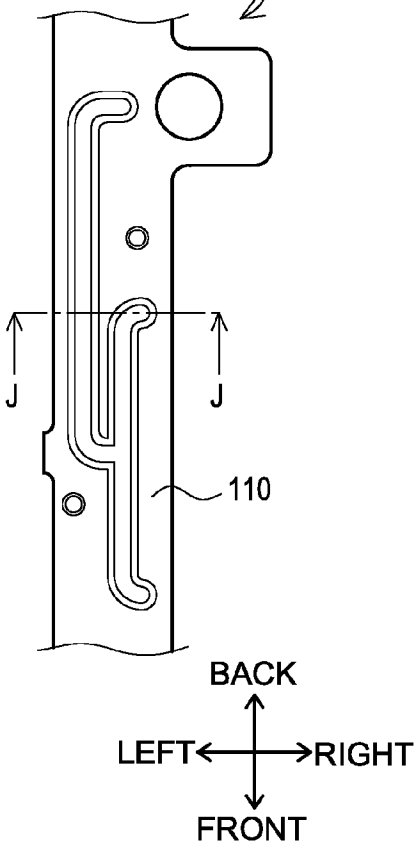
FIG. 22B is a plan view depicting the oil feed member, after folding, according to the seventh embodiment.
Figure 22C:
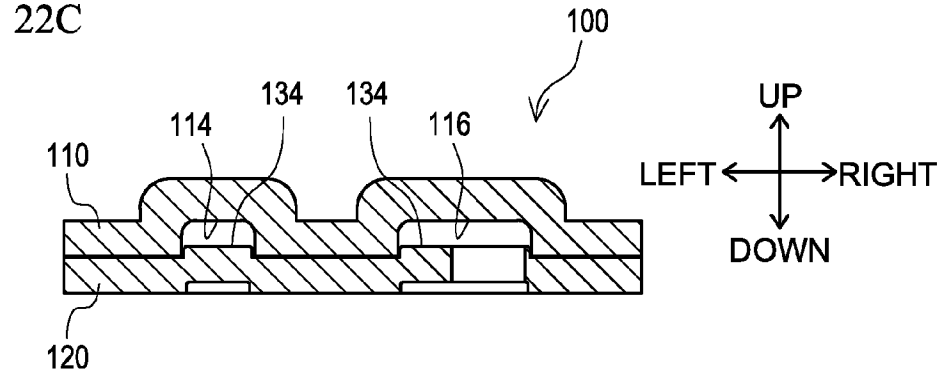
FIG. 22C is a cross-sectional view taken along line J-J in FIG. 22B.

As depicted in FIGS. 22A to 22C (a seventh embodiment), it is also conceivable that a projection 134 is provided on the second plate portion 120 of the oil feed member 100 so as to fit to the oil passages (the first oil passage 114, the second oil passage 116, and the third oil passage 118) on the first plate portion 110 when the oil feed member 100 is folded. With this configuration, when the oil feed member 100 is folded, the projection 134 fits to the oil passages (the first oil passage 114, the second oil passage 116, and the third oil passage 118) on the first plate portion 110. Thus, the oil passages may be more surely blocked. Hence, oil leakage of the lubricant circulating inside the oil passages may be suppressed.

Figure 23:
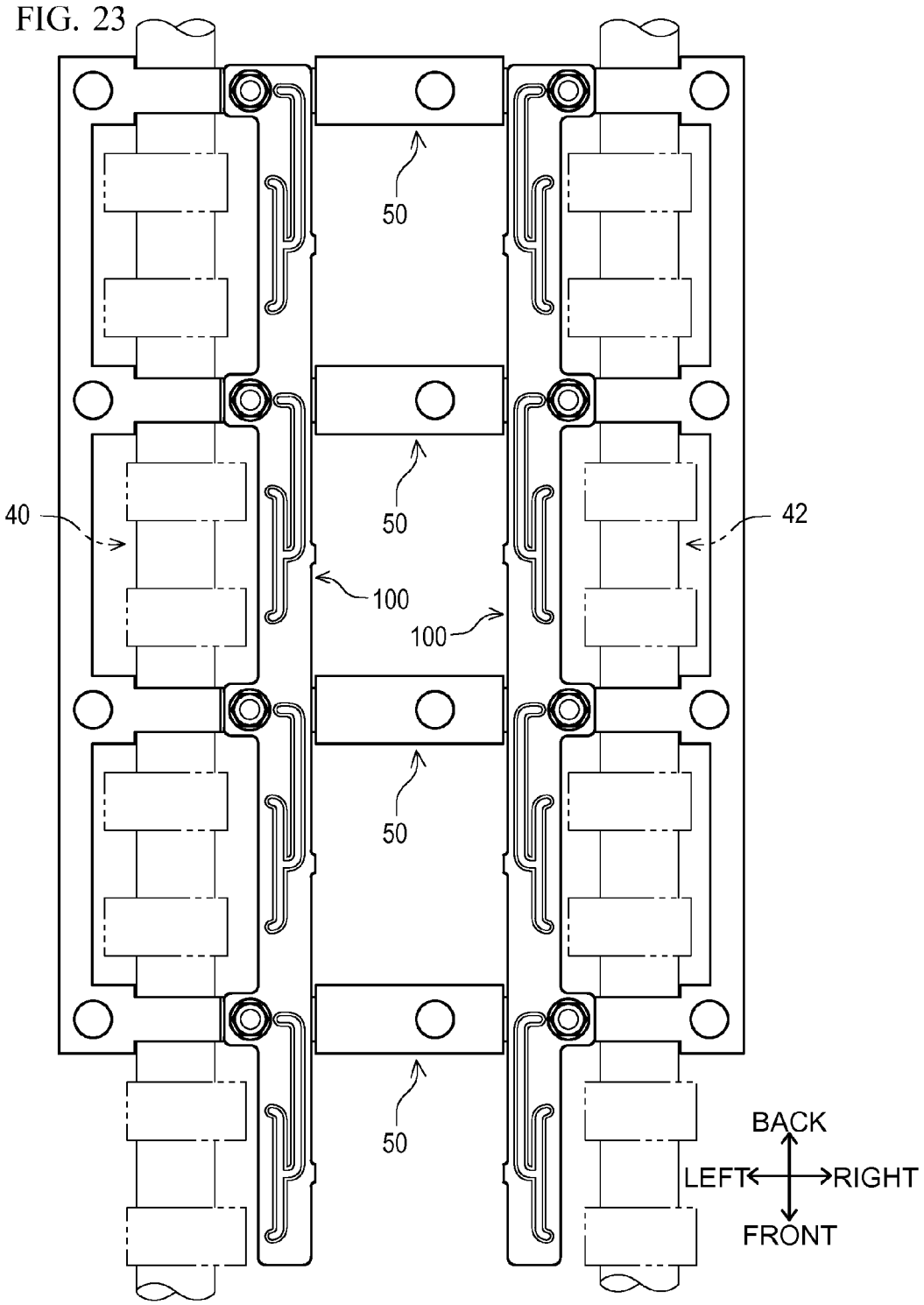
FIG. 23 is a plan view depicting cam caps and oil feed members according to an eighth embodiment.

As depicted in FIG. 23 (an eighth embodiment), it is also conceivable that four cam caps 50 that are provided to correspond to the four cylinders, respectively, may be integrated with each other. Specifically, the right and left end portions of each cam cap 50 are coupled to each other such that the four cam caps 50 are integrated with each other and are handled as a single member. This configuration facilitates management of components of the cam caps 50 and attachment of the cam cap to the cylinder head 10.

INDUSTRIAL APPLICABILITY

The present invention is applicable to a lubricant feed mechanism for an engine for feeding lubricant to cams of a valve gear through a cylinder head, a camshaft, cam caps, and an oil feed member.

DESCRIPTION OF REFERENCE SIGNS

1 Engine
10 Cylinder head
30 Valve gear
40 Intake-side camshaft
40*a* Cam
42 Exhaust-side camshaft
42*a* Cam
50 Cam cap
100 Oil feed member
110 First plate portion
114 First oil passage
116 Second oil passage
118 Third oil passage
120 Second plate portion
130 Guide portion

The invention claimed is:

1. A lubricant feed mechanism for an engine, the lubricant feed mechanism comprising:

a cylinder head;

a camshaft to which lubricant is fed through the cylinder head;

a cam cap to which lubricant is fed through the camshaft;

an oil feed member formed by folding a first part of a panel member onto a second part of the panel member, such that an inside surface of one of the parts of the panel member includes a recess so as to form an oil passage for guiding lubricant fed through the cam cap when the first part of the panel member is folded over on the second part of the panel member; and a cam of a valve gear to which lubricant is fed through the oil feed member, wherein the oil feed member comprises a plurality of coupling portions, which includes a folding portion, for coupling a part of an end portion of the first part with a part of an end portion of the second part, wherein the coupling portions are formed integrally with the first part and the second part and are arranged at intervals.

2. The lubricant feed mechanism for an engine, according to claim 1, wherein the oil feed member is integrally provided over a plurality of cylinders of the engine.

3. The lubricant feed mechanism for an engine, according to claim 1, wherein the oil feed member includes a guide portion for positioning the oil feed member with respect to the cam cap by plastically deforming a part of the oil feed member.

4. The lubricant feed mechanism for an engine, according to claim 1, wherein the cam cap includes a guide portion for positioning the cam cap with respect to the oil feed member.

5. The lubricant feed mechanism for an engine, according to claim 1, wherein the oil feed member is fastened together with the cam cap and is fixed to the cylinder head.

6. The lubricant feed mechanism for an engine, according to claim 1, wherein the cam cap has a recess, and the oil feed member has a portion contained within the recess of the cam cap and is disposed in the cam cap.

7. The lubricant feed mechanism for an engine, according to claim 1, wherein the oil passage provided in the oil feed member has a plurality of branches from a middle portion thereof and has a plurality of discharge ports for feeding lubricant to the cam, and the coupling portions are formed at positions corresponding to the branches.

8. The lubricant feed mechanism for an engine, according to claim 7, wherein the branched oil passages are configured to have the same length, the same cross-sectional shape, the same number of turns, and the same angle of turning.

9. The lubricant feed mechanism for an engine, according to claim 2, wherein the oil feed member includes a guide portion for positioning the oil feed member with respect to the cam cap by plastically deforming a part of the oil feed member.

10. The lubricant feed mechanism for an engine, according to claim 2, wherein the cam cap includes a guide portion for positioning the cam cap with respect to the oil feed member.

11. The lubricant feed mechanism for an engine, according to claim 3, wherein the cam cap includes a guide portion for positioning the cam cap with respect to the oil feed member.

12. The lubricant feed mechanism for an engine, according to claim 2, wherein the oil feed member is fastened together with the cam cap and is fixed to the cylinder head.

13. A lubricant feed mechanism for an engine, the lubricant feed mechanism comprising:

an oil feed member formed by folding a first part of a panel member onto a second part of the panel member, such that an inside surface of one of the parts of the panel member includes a recess so as to form an oil passage when the first part of the panel member is folded over on the second part of the panel member, wherein the oil feed member comprises a plurality of coupling portions, which includes a folding portion, for coupling a part of an end portion of the first part with a part of an end portion of the second part, wherein the coupling portions are formed integrally with the first part and the second part and are arranged at intervals, the oil passage configured for guiding lubricant fed through a cylinder head, a camshaft, and a cam cap to a cam of a valve gear.

14. The lubricant feed mechanism for an engine according to claim 13, wherein the oil feed member is integrally provided over a plurality of cylinders of the engine.

15. The lubricant feed mechanism for an engine according to claim 13, wherein the oil feed member includes a guide portion for positioning the oil feed member with respect to the cam cap by plastically deforming a part of the oil feed member.

16. The lubricant feed mechanism for an engine according to 13, wherein the cam cap includes a guide portion for positioning the cam cap with respect to the oil feed member.

17. The lubricant feed mechanism for an engine according to claim 13, wherein the oil feed member is fastened together with the cam cap and is fixed to the cylinder head.

18. The lubricant feed mechanism for an engine according to claim 13, wherein the cam cap has a recess, and the oil feed member has a portion contained within the recess of the cam cap and is disposed in the cam cap.

19. The lubricant feed mechanism for an engine according to claim 13, wherein the oil passage provided in the oil feed member has a plurality of branches from a middle portion thereof and has a plurality of discharge ports for feeding lubricant to the cam, and the coupling portions are formed at the position corresponding to the branches.

20. The lubricant feed mechanism for an engine according to claim 19, wherein the branched oil passages are configured to have the same length, the same cross-sectional shape, the same number of turns, and the same angle of turning.

* * * * *